US007616179B2

(12) United States Patent
Nakagawa et al.

(10) Patent No.: US 7,616,179 B2
(45) Date of Patent: Nov. 10, 2009

(54) ORGANIC EL DISPLAY APPARATUS AND DRIVING METHOD THEREFOR

(75) Inventors: Katsumi Nakagawa, Yokohama (JP); Somei Kawasaki, Saitama (JP); Masami Iseki, Yokohama (JP); Yutaka Inaba, Hino (JP)

(73) Assignee: Canon Kabushiki Kaisha, Tokyo (JP)

( * ) Notice: Subject to any disclaimer, the term of this patent is extended or adjusted under 35 U.S.C. 154(b) by 455 days.

(21) Appl. No.: 11/693,931

(22) Filed: Mar. 30, 2007

(65) Prior Publication Data

US 2007/0229428 A1 Oct. 4, 2007

(30) Foreign Application Priority Data

Mar. 31, 2006 (JP) ..... 2006-098009
Mar. 31, 2006 (JP) ..... 2006-098010

(51) Int. Cl.
*G09G 3/36* (2006.01)

(52) U.S. Cl. ..... 345/82; 345/205; 345/206

(58) Field of Classification Search ..... 345/55, 345/92, 82, 204, 205, 206; 315/169.1, 169.2, 315/169.3

See application file for complete search history.

(56) References Cited

U.S. PATENT DOCUMENTS 4,625,224 A 11/1986 Nakagawa et al. ..... 357/23.7
4,674,839 A 6/1987 Tsuboyama et al. ..... 350/334
4,738,515 A 4/1988 Okada et al. ..... 350/350 S
4,766,477 A 8/1988 Nakagawa et al. ..... 357/59
4,814,842 A 3/1989 Nakagawa et al. ..... 357/23.7
4,836,656 A 6/1989 Mouri et al. ..... 350/350 S
4,838,652 A 6/1989 Inaba et al. ..... 350/331 R
4,878,740 A 11/1989 Inaba et al. ..... 350/337
4,886,977 A 12/1989 Gofuku et al. ..... 250/578
4,925,277 A 5/1990 Inaba ..... 350/350 S
4,930,875 A 6/1990 Inoue et al. ..... 350/333
4,932,759 A 6/1990 Toyono et al. ..... 350/350 S
4,958,912 A 9/1990 Inaba et al. ..... 350/333
4,958,915 A 9/1990 Okada et al. ..... 350/345
5,018,841 A 5/1991 Mouri et al. ..... 350/350 S
5,026,144 A 6/1991 Taniguchi et al. ..... 350/350 S
5,034,735 A 7/1991 Inoue et al. ..... 340/784
5,132,818 A 7/1992 Mouri et al. ..... 359/56

(Continued)

FOREIGN PATENT DOCUMENTS

WO WO 2005/088726 A1 9/2005

*Primary Examiner*—David Hung Vu
(74) *Attorney, Agent, or Firm*—Fitzpatrick, Cella, Harper & Scinto

(57) ABSTRACT

An organic EL display apparatus has a driving circuit. In the driving circuit, the source and drain of a driving transistor and the anode and cathode of an organic EL device are connected in series between voltage sources. A current passes between the source and drain of the driving transistor and between the anode and cathode of the organic EL device in accordance with a voltage between the gate and source of the driving transistor. Consequently, the organic EL device emits light. In order to store the voltage in the capacitor, a constant voltage source is connected to the gate of the driving transistor and the above-described series connection is disconnected at the source of the driving transistor and connected to a signal source. Then, a current signal output from the signal source passes between the source and drain of the driving transistor, and charges are stored in a capacitor in accordance with the current signal.

15 Claims, 24 Drawing Sheets

U.S. PATENT DOCUMENTS

| | | | | |
|---|---|---|---|---|
| 5,136,282 | A | 8/1992 | Inaba et al. | 340/784 |
| 5,136,408 | A | 8/1992 | Okada et al. | 359/56 |
| 5,227,900 | A | 7/1993 | Inaba et al. | 359/56 |
| 5,233,447 | A | 8/1993 | Kuribayashi et al. | 359/56 |
| 5,255,110 | A | 10/1993 | Mouri et al. | 359/56 |
| 5,267,065 | A | 11/1993 | Taniguchi et al. | 359/56 |
| 5,408,246 | A | 4/1995 | Inaba et al. | 345/89 |
| 5,440,412 | A | 8/1995 | Mouri et al. | 359/56 |
| 5,469,281 | A | 11/1995 | Katakura et al. | 359/56 |
| 5,471,229 | A | 11/1995 | Okada et al. | 345/89 |
| 5,519,411 | A | 5/1996 | Okada et al. | 345/89 |
| 5,521,727 | A | 5/1996 | Inaba et al. | 359/56 |
| 5,532,713 | A | 7/1996 | Okada et al. | 345/97 |
| 5,592,190 | A | 1/1997 | Okada et al. | 345/89 |
| 5,598,229 | A | 1/1997 | Okada et al. | 348/792 |
| 5,638,195 | A | 6/1997 | Katakura et al. | 349/143 |
| 5,638,196 | A | 6/1997 | Mouri et al. | 345/97 |
| 5,646,755 | A | 7/1997 | Okada et al. | 345/97 |
| 5,657,038 | A | 8/1997 | Okada et al. | 345/94 |
| 5,689,320 | A | 11/1997 | Okada et al. | 349/135 |
| 5,703,614 | A | 12/1997 | Mouri et al. | 345/97 |
| 5,717,421 | A | 2/1998 | Katakura et al. | 345/101 |
| 5,754,154 | A | 5/1998 | Katakura et al. | 345/97 |
| 5,815,130 | A | 9/1998 | Taniguchi et al. | 345/94 |
| 5,815,131 | A | 9/1998 | Taniguchi et al. | 345/94 |
| 5,815,132 | A | 9/1998 | Okada et al. | 345/95 |
| 5,844,536 | A | 12/1998 | Okada et al. | 345/94 |
| 5,847,686 | A | 12/1998 | Mouri et al. | 345/94 |
| 5,973,657 | A | 10/1999 | Okada et al. | 345/89 |
| 6,054,971 | A | 4/2000 | Okada et al. | 345/89 |
| 6,061,045 | A | 5/2000 | Inaba | 345/95 |
| 6,177,968 | B1 | 1/2001 | Okada et al. | 349/38 |
| 6,222,517 | B1 | 4/2001 | Iba et al. | 345/94 |
| 6,229,506 | B1 | 5/2001 | Dawson et al. | 345/82 |
| 6,304,310 | B1 | 10/2001 | Kawagishi et al. | 349/172 |
| 6,373,454 | B1 | 4/2002 | Knapp et al. | 345/76 |
| 7,006,062 | B2 * | 2/2006 | Li | 345/82 |
| 7,499,042 | B2 * | 3/2009 | Shirasaki et al. | 345/211 |
| 2007/0194379 | A1 | 8/2007 | Hosono et al. | 257/347 |
| 2007/0229554 | A1 | 10/2007 | Kawasaki et al. | 345/694 |

* cited by examiner

ORGANIC EL DISPLAY APPARATUS AND DRIVING METHOD THEREFOR

BACKGROUND OF THE INVENTION

1. Field of the Invention

The present invention relates to an organic EL (electroluminescence) display apparatus and a driving method therefor.

2. Description of the Related Art

An organic electroluminescence device utilizing electroluminescence (hereinafter abbreviated as EL) of an organic material has a first electrode, a second electrode, and an organic compound layer sandwiched between the electrodes. The organic compound layer includes a light emission layer and a carrier transport layer which are composed of organic molecules. The organic EL device is driven by a current passing between the electrodes. The luminance of the organic EL device is almost exactly proportional to the current (driving current). An organic EL display apparatus in which organic EL devices are arranged in a matrix form has excellent color reproducibility and excellent responsiveness to an input signal, and is therefore ideal particularly for display of moving color images. Furthermore, the organic EL display apparatus can emit light of high luminance and has a wide viewing angle, and therefore can be used in various environments. As a material used for the organic compound layer, there are low-molecular-weight materials ideal for vacuum deposition, oligomer and polymer materials ideal for spin coating and ink-jet coating. Currently, low-molecular-weight materials are in widespread use. However, oligomer and polymer materials, which are ideal for display on a large screen, will probably be used increasingly in the future.

Examples of a pixel driving method are the passive matrix method and the active matrix method. In the passive matrix method, a current is directly passed between first electrodes formed in a striped pattern and second electrodes formed in a striped pattern, the striped patterns being orthogonal to each other, so as to cause organic EL devices sandwiched between the first and second electrodes to emit light. In the active matrix method, pixel circuits each composed of thin-film transistors (hereinafter abbreviated as TFTs), a capacitor, etc. and each used to drive an organic EL device, are arranged in a matrix form. Image signals are individually transmitted to pixels, and are then maintained in corresponding pixel circuits. Organic EL devices emit light in accordance with the maintained pixel signals, thereby displaying an image. In the case of the active matrix method, image signals to be transmitted to individual pixels are rarely mixed. Accordingly, this method is ideal particularly for a display apparatus with a large screen, high definition, and a large number of pixels.

The active matrix driving method is roughly classified into the voltage programming method and the current programming method. In the voltage programming method, a potential, which serves as an image signal, is directly applied to the gate of a driving TFT and is then maintained. A current passing through the driving TFT is controlled by the potential of the gate thereof. However, the relationship between the current and the potential of the gate varies according to the TFT, and sometimes changes with operating time. Accordingly, in the case of the voltage programming method, luminance is prone to vary from pixel to pixel, and image burn-in is prone to occur. On the other hand, in the case of the current programming method, a current, which serves as an image signal, is passed through a driving TFT included in each pixel just before an image is displayed, and the gate potential of the driving TFT at that time is maintained. Accordingly, variation of driving TFT characteristics and a change in driving TFT characteristics with time have little effect on display of an image compared with the voltage programming method.

FIG. 3 shows an example of a driving circuit compliant with the current programming method disclosed in U.S. Pat. No. 6,373,454. This driving circuit includes pixel circuits 100, first constant voltage sources 101, second constant voltage sources 102, signal lines 103, and signal current sources 104 connected to the signal lines 103.

Each of the pixel circuits 100 includes an organic EL device 106 one of whose electrodes is connected to one of the first constant voltage sources 101, a driving TFT 107 whose drain is connected to the other electrode of the organic EL device 106, a voltage maintaining unit 108 for maintaining a gate-to-source voltage of the driving TFT 107, a first switch 109 disposed between the gate and drain of the driving TFT 107, a second switch 110 disposed between the source of the driving TFT 107 and one of the signal lines 103, and a third switch 111 disposed between the source of the driving TFT 107 and one of the second constant voltage sources 102.

In a programming period, that is, a signal write period, the first switch 109 and the second switch 110 are closed and the third switch 111 is opened so as to provide a signal current for the source of the driving TFT 107 in accordance with an image signal transmitted from one of the signal current sources 104. The source-to-gate voltage at that time is maintained in the voltage (capacitance in FIG. 3) maintaining unit 108 disposed between the source and the gate.

In an image display period, the first switch 109 and the second switch 110 are opened, and the third switch 111 is closed. Consequently, a current passes through the driving TFT 107 in accordance with the source-to-gate voltage determined and maintained in the signal write period, whereby the organic EL device 106 emits light.

The driving TFT 107 shown in FIG. 3 is a p-channel TFT. The drain terminal of the driving TFT 107 is connected to the anode of the organic EL device 106, so that a current passes from the drain to the organic EL device 106. If the driving TFT 107 is an n-channel TFT, the positions of the source and drain may be interchanged. The drain terminal may be connected to the cathode of the organic EL device 106, so that a current passes from the organic EL device 106 to the drain. This example is disclosed in U.S. Pat. No. 6,229,506.

The pixel circuits 100 are formed on a glass substrate using amorphous silicon or polysilicon. However, a metal oxide such as InGaZnO disclosed in WO 05/088726 may be used.

An organic EL display apparatus is often used in mobile apparatuses such as mobile telephones or digital cameras. Accordingly, power consumption is required to be reduced. In order to reduce power consumption during the image display period, it is advantageous that a power supply voltage (a voltage between the first and second constant voltage sources in FIG. 3) is reduced.

In the case of a known pixel circuit compliant with the current programming method, a driving TFT is diode-connected at the time of current programming. Subsequently, a signal current is externally provided for the driving TFT, whereby a gate-to-source voltage of the driving TFT is determined and maintained. In the image display period, a current that is the same as the signal current is passed through an organic EL device in accordance with the maintained gate-to-source voltage.

When the organic EL device emits light at the maximum luminance, the gate-to-source voltage of the driving TFT and the current passing through the organic EL device also become maxima. At least the sum of the voltage across the organic EL device when it emits light at the maximum luminance and the gate-to-source voltage of the driving TFT at that time is required as a power supply voltage. A voltage lower than the sum cannot be used.

In order to further reduce power consumption of the organic EL display apparatus, a new driving circuit is required instead of the known driving circuit compliant with the current programming method.

Like the above-described power supply voltage, a voltage of an output terminal of a signal current source also becomes the maximum value when the organic EL device emits light at the maximum luminance. Accordingly, at least the sum of the voltage across the organic EL device when it emits light at the maximum luminance and the gate-to-source voltage of the driving TFT at that time is required as a power supply voltage used to drive the signal current source. From the viewpoint of power saving, the power supply voltage for the signal current source is preferably reduced.

SUMMARY OF THE INVENTION

The present invention provides a driving method for an organic EL display apparatus capable of accurately performing image display with less power and a driving circuit suitable for performing the driving method.

According to an aspect of the present invention, there is provided a driving method of an organic EL device in which, when the organic EL device emits light, a source and a drain of a driving transistor and an anode and a cathode of the organic EL device are connected in series between first and second constant voltage sources and a current flows between the anode and the cathode of the organic EL device in accordance with a gate-to-source voltage of the driving transistor. The gate-to-source voltage of the driving transistor being set in the following steps: (1) disconnecting the series connection of the driving transistor and the organic EL device at the source of the driving transistor; (2) connecting a third constant voltage source maintaining a potential different from a potential of each of the first and second constant voltage sources to a gate of the driving transistor; (3) connecting the source of the driving transistor to a signal current source and passing a signal current between the source and the drain of the driving transistor to generate a voltage between the gate and the source of the driving transistor in a capacitor disposed between the gate and the source of the driving transistor; (4) disconnecting the gate of the driving transistor from the third constant voltage source; (5) disconnecting the source of the driving transistor from the signal current source; and (6) reconnecting the source of the driving transistor to recover the series connection of the driving transistor and the organic EL device.

According to another aspect of the present invention, there is provided an organic EL display apparatus including: an organic EL device having two terminals, an anode and a cathode; a driving transistor having three terminals, a gate, a source, and a drain; a capacitor disposed between the gate and the source of the driving transistor; first, second, and third constant voltage sources each maintaining a constant voltage; a signal current source providing a signal current; a first switch disposed between the gate of the driving transistor and the third constant voltage source; a second switch disposed between the source of the driving transistor and the signal current source; a third switch disposed between the source of the driving transistor and the second constant voltage source; and an opening and closing control portion for controlling opening and closing of the first to third switches.

In a driving circuit according to an embodiment of the present invention, when an image signal is written into a driving TFT that controls a current to be sent to an organic EL device, a potential determined in advance is externally applied to the gate of the driving TFT. Consequently, even if a signal current source and a power supply voltage at the time of image display are lowered, the driving TFT can operate in a saturation region. Even if a TFT having incomplete saturation characteristics is used, a current passing through the organic EL device in an image display period can be more accurately written. Thus, image display can be accurately achieved with less power. In addition, the driving circuit has a simple configuration and is adaptable to various TFTs. Accordingly, it can be easily produced and can be used to achieve high-definition organic EL display apparatuses with large screens.

Further features of the present invention will become apparent from the following description of exemplary embodiments with reference to the attached drawings.

DESCRIPTION OF THE EMBODIMENTS

Operation of Circuit Programming Circuit

For comparison between a driving circuit according to an embodiment of the present invention and a known driving circuit, first, a known current programming circuit shown in FIG. 3 and the operation thereof will be described.

Figure 3:
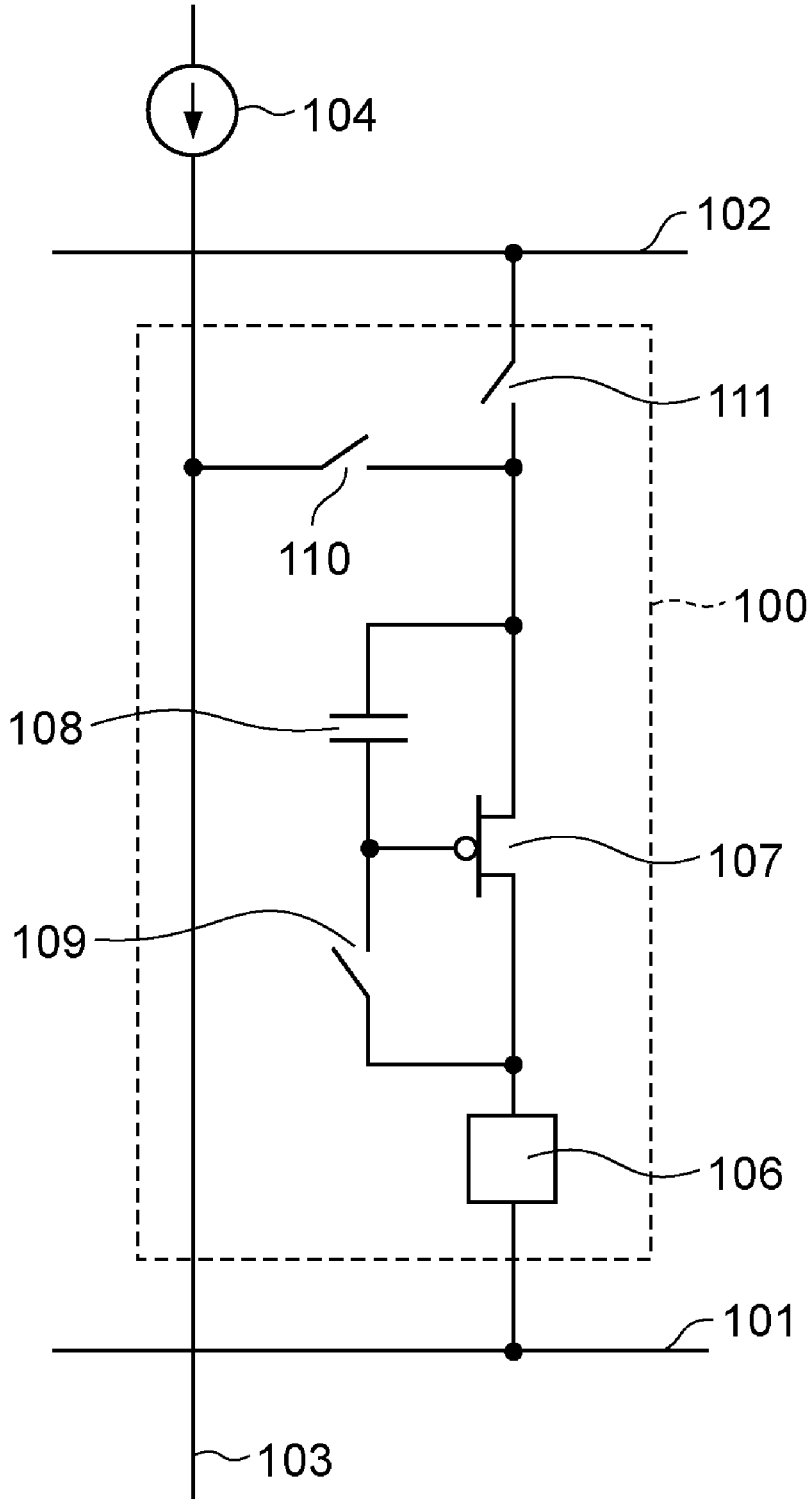
PRIOR ART FIG. 3
FIG. 3 is a diagram used to describe a driving circuit included in a known organic EL display apparatus by focusing on a pixel circuit.
Figure 4:
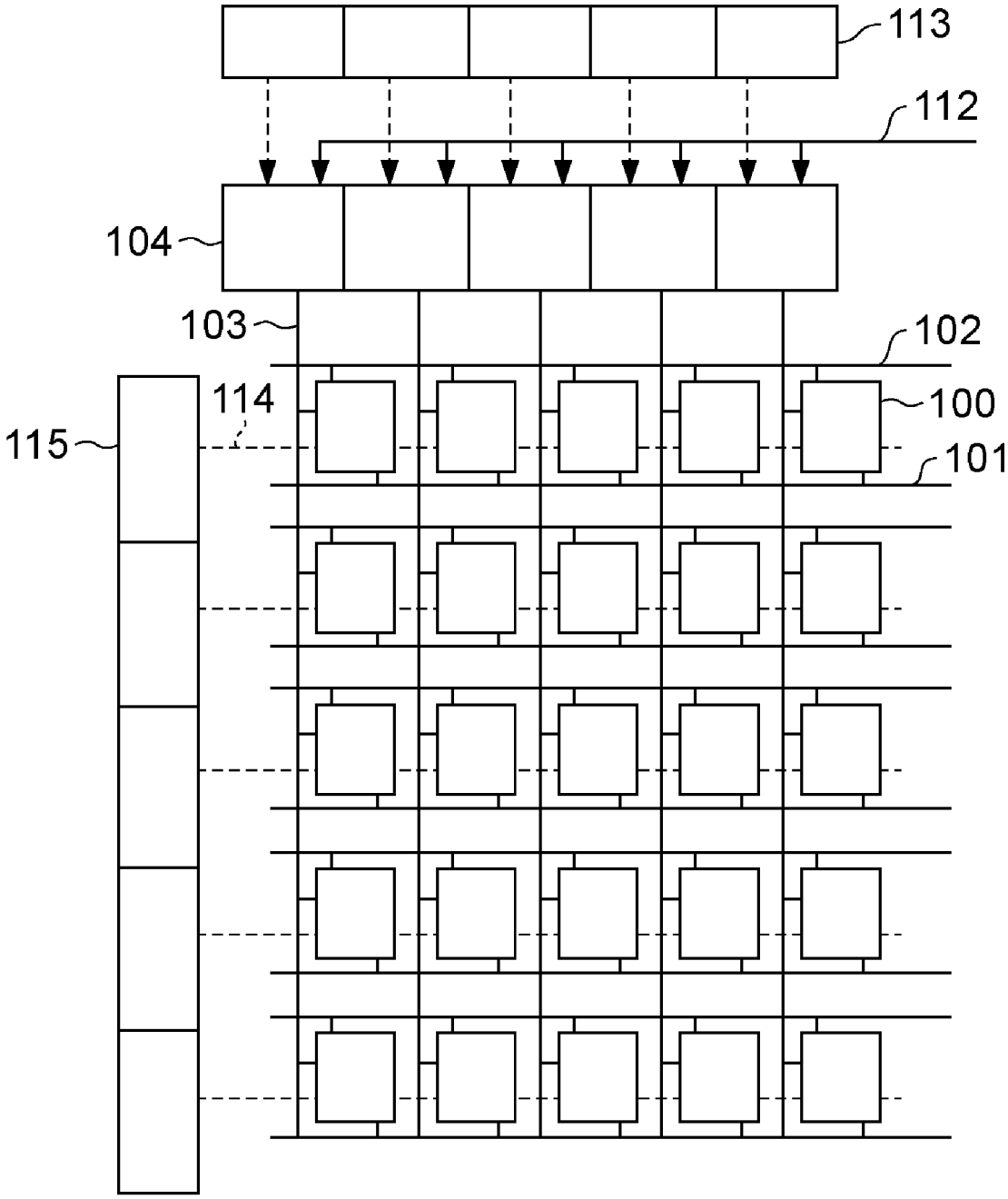
PRIOR ART FIG. 4
FIG. 4 is a diagram used to describe an entire configuration of a known organic EL display apparatus including driving circuits.

FIG. 4 shows the entire driving circuit of a display apparatus in which the pixel circuits 100 shown in FIG. 3 are arranged in a matrix form. The internal configuration of each of the pixel circuits 100 is shown in FIG. 3, and is therefore omitted in FIG. 4.

The pixel circuits 100 are connected to the corresponding first constant voltage sources 101 and the corresponding second constant voltage sources 102. The pixel circuits 100 in the same column are connected to one of the signal lines 103. The pixel circuits 100 in the same row are connected to one of scanning lines 114. The opening and closing of the first switch 109, the second switch 110, and the third switch 111 are controlled in accordance with a potential applied to one of the scanning lines 114.

An image signal 112, which has been transmitted as a time series signal, is input into the signal current sources 104 at the same time. However, at a certain point, the image signal 112 is input into only one of the signal current sources 104 in a specific column that has been selected on the basis of a signal transmitted from a horizontal shift register 113. The horizontal shift register 113 sequentially selects the signal current sources 104 so as to input an image signal into the signal current sources 104 in all columns.

A unique signal current is output from each of the signal current sources 104 to one of the signal lines 103. The pixel circuits 100 in the same column are connected to one of the signal lines 103. However, at a certain point, the signal current on one of the signal lines 103 is input into only one of the pixel circuits 100 in a specific row that has been selected on the basis of a signal transmitted from a vertical shift register 115 to one of the scanning lines 114. At that time, the pixel circuits 100 in the same column and in rows other than the selected row are electrically separated from the one of the signal lines 103. The vertical shift register 115 sequentially selects the pixel circuits 100 in a vertical direction so as to input the signal current into the pixel circuits 100 in all rows.

Figure 5:
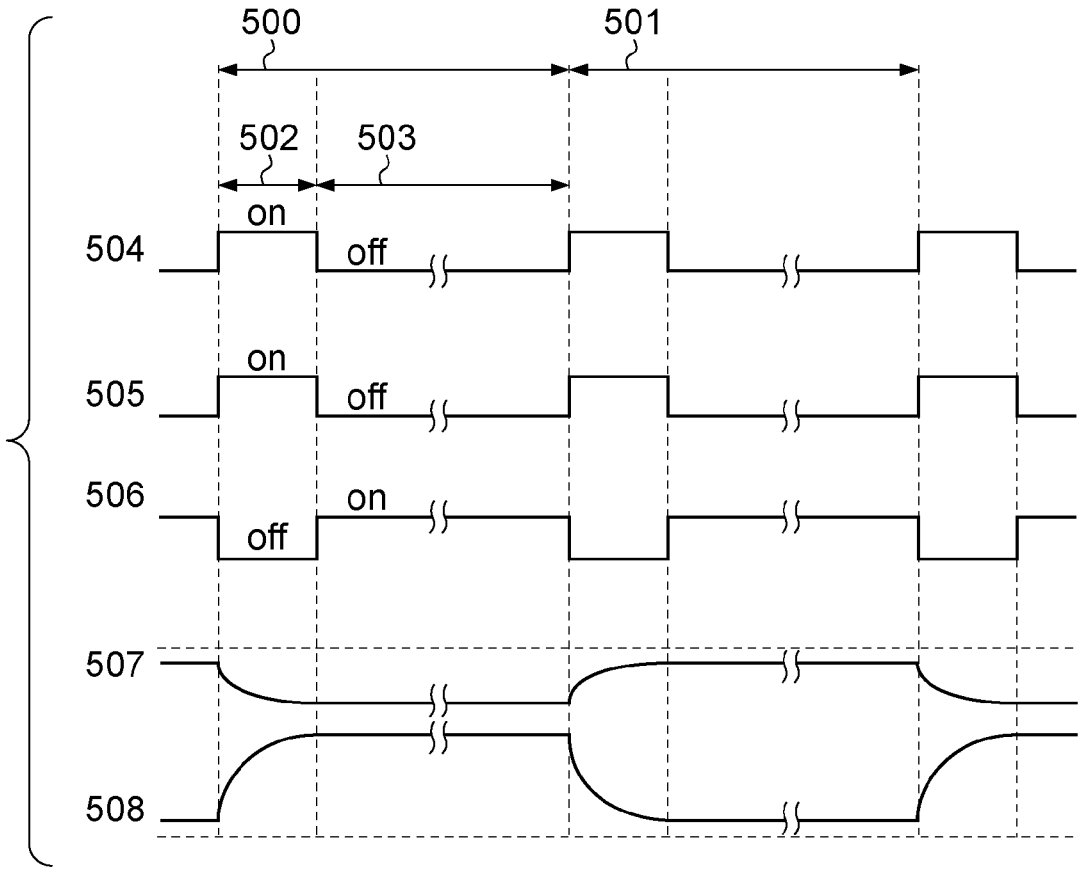
FIG. 5 is a diagram used to describe driving sequences in a driving circuit included in an organic EL display apparatus according to an embodiment of the present invention and a known organic EL display apparatus.

FIG. 5 is a chart showing an operation sequence of each switch. The operations of the circuits shown in FIGS. 3 and 4 will be described with reference to FIG. 5. Periods 500 and 501 individually denote one frame period. If thirty frames are displayed per second, one frame period is 33 msec. In the period 500 shown in FIG. 5, high-luminance display is performed. In the period 501, low-luminance display is performed. One frame period includes a signal write period 502 and an image display period 503.

Operation sequences 504, 505, and 506 denote operation sequences of the first, second, and third switches, respectively. The level shown in each of the operation sequences 504 to 506 does not represent the actual level of a gate voltage, but rather simply a high level represents the switch being closed (ON) and a low level represents the switch being opened (OFF).

The change in a gate-to-source voltage 507 of a driving TFT and the change in a driving current 508 of the driving TFT are shown. Here, in the gate-to-source voltage 507, a dotted line represents a source potential, and a solid line represents a gate potential. The channel conductivity type of the driving TFT 107 is p channel. Accordingly, if the gate potential is lower than the source potential by a threshold voltage, the driving current 508 passes from a source to a drain.

Figure 6A:
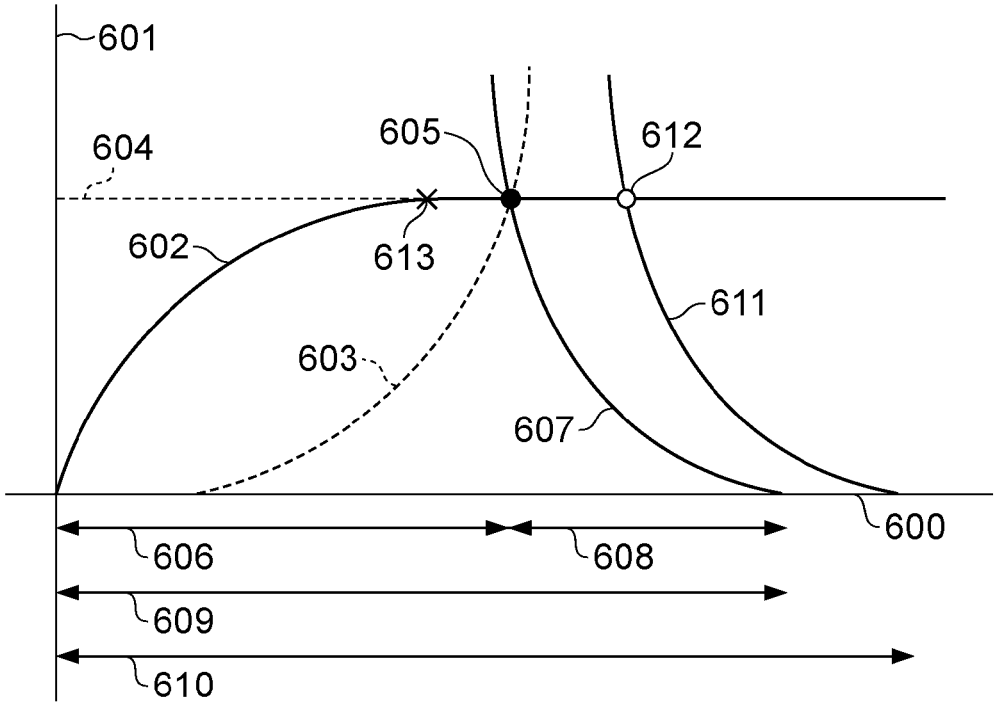
FIGS. 6A and 6B are diagrams used to describe operations of a driving circuit using a driving TFT having complete saturation characteristics in a known organic EL display apparatus.
Figure 6B:
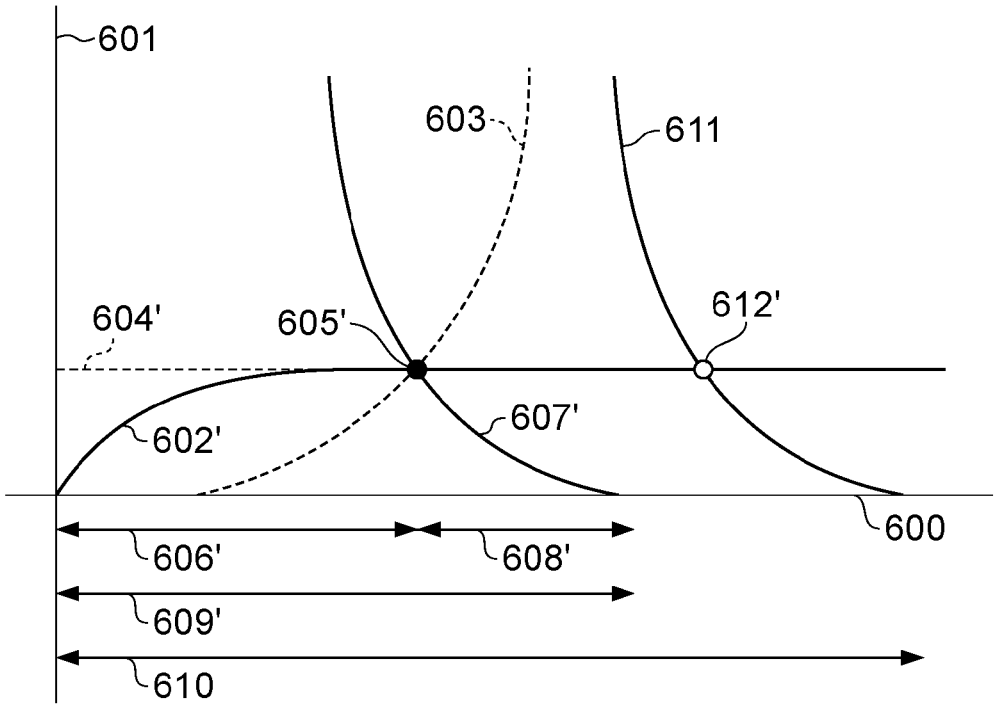

FIG. 6A shows how the operation point of the circuit shown in FIG. 3 is determined in the case of display at the maximum luminance. FIG. 6B shows how the operation point of the circuit shown in FIG. 3 is determined in the case of display at low luminance. A horizontal axis is a voltage axis 600. A vertical axis is a current axis 601. A plurality of relationships between a voltage and a current are illustrated in FIGS. 6A and 6B. The voltage axis 600 represents a drain potential based on a source potential. In reality, the drain potential changes in a negative direction, however, in FIGS. 6A and 6B, the drain potential is shown as changing in a positive direction. It may be considered that the origin is the source potential and the potential decreases from left to right. A direction in which a current flows to the first constant voltage source is defined as a positive direction.

A case shown in FIG. 6A in which a signal current 604 is the maximum value will be described. A case of FIG. 6B can be similarly described.

A curve 602 represents the drain current of the driving TFT 107 when the gate-to-source voltage is maintained constant. As the drain potential increases in the negative direction, that is, as the source-to-drain voltage increases, the drain current increases. However, when the source-to-drain voltage is equal to or larger than a predetermined voltage 613 (hereinafter referred to as a saturation drain voltage), the drain current is maintained substantially constant. In FIG. 6A, it is assumed that the driving TFT 107 has saturation characteristics in which the drain current is maintained perfectly constant at equal to or larger than the saturation drain voltage.

A dotted line 603 represents a relationship between the source-to-drain voltage and the drain current in a state in which the drain and source of the driving TFT 107 are short-circuited (diode-connected).

In a saturation region in which the drain current is maintained constant, the drain potential is lower than a channel potential at the drain terminal of a channel. That is, the pinch-off state in which the p-n junction is reverse-biased occurs.

The saturation drain voltage 613 is a pinch-off start voltage, that is, a drain voltage when the channel potential is equal to the drain potential at the drain terminal. The gate potential is lower than the channel potential by a threshold voltage. Accordingly, the source-to-drain voltage providing the drain current characteristics 602 is larger than the saturation drain voltage 613 by the threshold voltage. When the TFT is diode-connected, the drain voltage is therefore higher than the saturation drain voltage 613 by the threshold voltage. The above corresponds to a first operation point 605.

A curve 611 shown in FIG. 6A represents a relationship of a voltage between two electrodes of the organic EL device and a current between them. When the voltage between the electrodes of the organic EL device is zero, the current between them is zero. Accordingly, that condition is shown at the horizontal axis at that time. That is, the drain potential based on the source potential is equal to a potential of the first constant voltage source. As the voltage between the electrodes of the organic EL device increases, the current passing through the organic EL device increases. This corresponds to a direction in which the drain potential is higher than the potential of the first constant voltage source. In FIG. 6A, as the drain potential moves in the negative direction, the current passing through the organic EL device increases.

In the signal write period 502, the first switch 109 and the second switch 110 are closed and the third switch 111 shown in FIG. 3 is open in the circuit shown in FIG. 3. Accordingly, the characteristics of the driving TFT 107 are represented by the dotted line 603. At that time, the signal current 604 represented by a horizontal line in FIG. 6A passes from the signal current source to the source of the driving TFT 107 and flows as a drain current. Accordingly, an intersection 605 of the characteristics curve (the dotted line 603) and the curve depicting the signal current 604 at the time of diode-connection is determined as the drain potential in FIG. 6A. This intersection 605 is called a first operation point. Furthermore, since the same driving current passes through the organic EL device 106 connected to the driving TFT 107 in series, an organic EL device characteristics curve 607 passes through the first operation point 605. A voltage between electrodes of the organic EL device 106 is represented by a double sided arrow 608 in FIG. 6A.

The gate potential of the driving TFT 107 is determined by the source-to-gate voltage of the drain current characteristics 602 depicted by a curve passing through the first operation point 605. This source-to-gate voltage is used to determine an electric charge of the capacitor 108 disposed between the source and the gate.

A voltage drop from the output terminal of one of the signal current sources 104 to the first constant voltage source in the signal write period 502 is the sum of a source-to-drain voltage 606 of the driving TFT and the voltage across the organic EL device 608. Accordingly, the voltage drop corresponds to a magnitude represented by a double sided arrow 609 shown in FIG. 6A. This magnitude also corresponds to a voltage of the output terminal of one of the signal current sources 104 for the potential of the first constant voltage source.

In the image display period 503, the first switch 109 and the second switch 110 are opened and the third switch 111 is closed. The source potential of the driving TFT 107 is equal to the potential of one of the second constant voltage sources 102. Since the first switch is opened, the capacitor 108 maintains a charge determined in the signal write period and the source-to-gate voltage of the driving TFT 107.

Accordingly, the drain current characteristics in the signal write period 502 and the drain current characteristics in the image display period 503 are the same, and are represented by the same curve 602 in FIG. 6A.

Since the diode-connection of the driving TFT 107 is disconnected, a drain voltage cannot be determined by the characteristics at the time of diode-connection 603. Alternatively, since the source potential is fixed to the potential of the second constant voltage source, a current zero position of the organic EL device current and voltage characteristics 611 is determined by a voltage between the first and second constant voltage sources (the magnitude represented by an double sided arrow 610 in FIG. 6A). Accordingly, an operation point is the intersection of the curve depicting the organic EL device characteristics 611 and the curve depicting the driving TFT drain current characteristics 602 (hereinafter referred to as a second operation point 612).

When the driving TFT 107 has complete saturation characteristics, the voltage between the first and second constant voltage sources (hereinafter referred to as a power supply voltage) should be set so that it can be equal to or larger than the signal source voltage 609. Consequently, even if the operation point 605 is changed to the operation point 612, a driving current is not changed.

The case in which the signal current 604 is the maximum value has been described with reference to FIG. 6A. Even if the signal current is lowered to a level shown in FIG. 6B, the basic operation of a case shown in FIG. 6B is the same as that of the case shown in FIG. 6A.

In FIG. 6B, the same reference numerals as those of FIG. 6A are used. If an element has a value or a shape different from that of a corresponding element shown in FIG. 6A, a prime indicator is added to the reference numeral of the element. In FIG. 6B, the signal current 604' is smaller than the signal current 604. The potential of the first operation point 605' is lower than that of the first operation point 605. The potential of the second operation point 612' is higher than that of the second operation point 612. Accordingly, a moving distance from the first operation point 605' to the second operation point 612' is larger than that from the first operation point 605 to the second operation point 612. However, the driving current is not changed in the saturation characteristics region.

In the above description, it was assumed that the driving TFT had complete saturation characteristics as shown in FIGS. 6A and 6B.

It can be considered that as the screens of display apparatuses increase in size, semiconductors such as metal oxides (InGaZnO disclosed in WO 05/088726, amorphous silicon, and ZnO) and organic semiconductors (polythiophene and pentacene), with which display apparatuses having large screens can be easily produced, will be in widespread use. TFTs composed of these semiconductors sometimes have incomplete saturation characteristics. Polysilicon TFTs that have been widely used are also prone to have incomplete saturation characteristics if the channel length is shortened so as to achieve high definition.

Figure 7A:
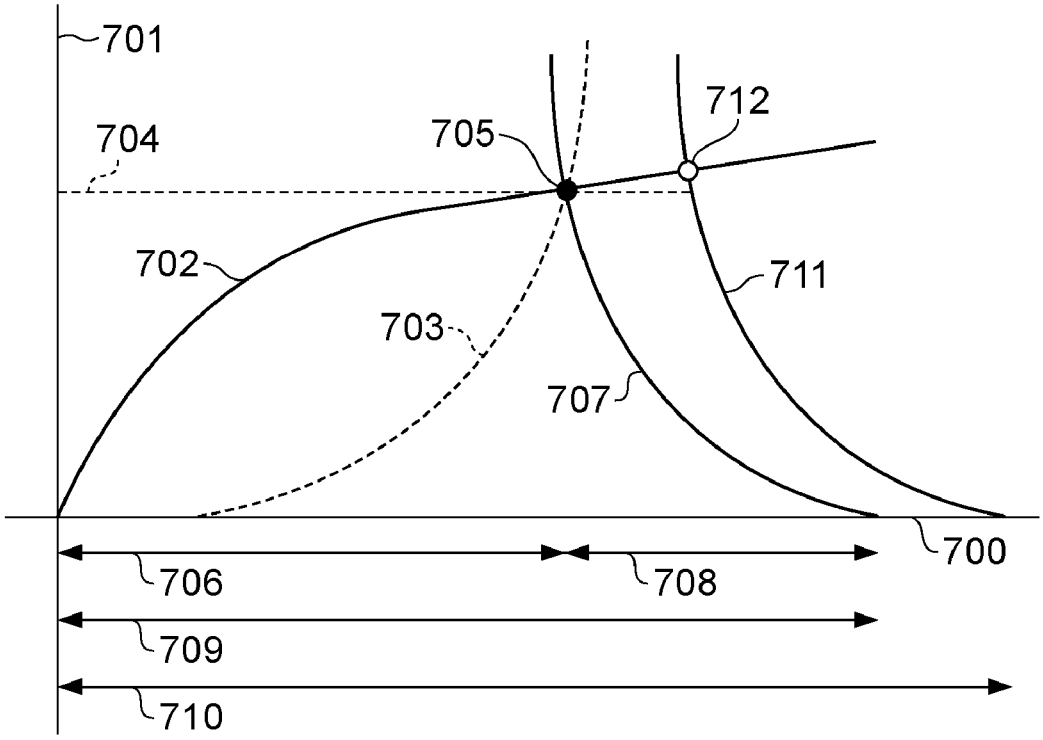
FIGS. 7A and 7B are diagrams used to describe operations of a driving circuit using a driving TFT having incomplete saturation characteristics in a known organic EL display apparatus.
Figure 7B:
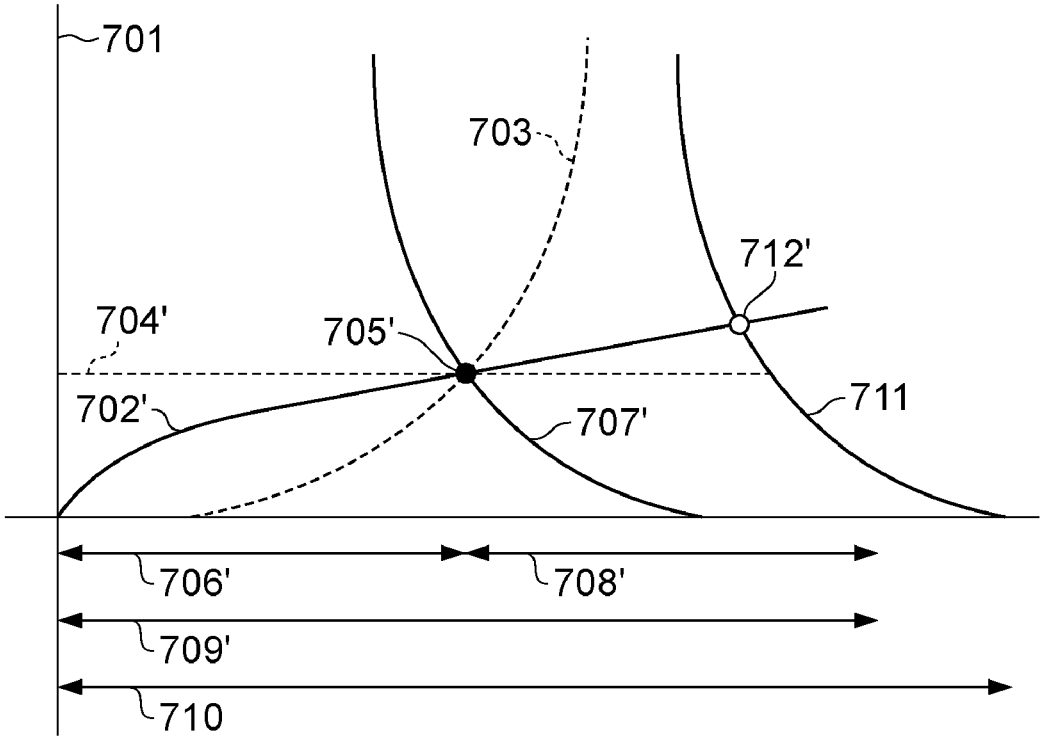

A case in which the driving TFT 107 has incomplete saturation characteristics will be described with reference to FIGS. 7A and 7B. Like FIG. 6A, FIG. 7A shows how the operation point of the circuit shown in FIG. 3 is determined in the case of display at the maximum luminance. Like FIG. 6B, FIG. 7B shows how the operation point of the circuit shown in FIG. 3 is determined in the case of display at low luminance. Since the driving TFT 107 has incomplete saturation characteristics, drain currents 702 and 702' are not maintained constant even if the drain-to-source voltage is equal to or larger than a saturation voltage. Accordingly, a current at a first operation point 705 and a current at a second operation point 712 are different. This means that a current at the time of programming and a current at the time of display are different. As a result, display processing cannot be accurately performed. In FIG. 7B, since the moving distance between the operation points 705' and 712' is larger than that between the operation points 705 and 712 shown in FIG. 7A, this becomes more notable.

Figure 8:
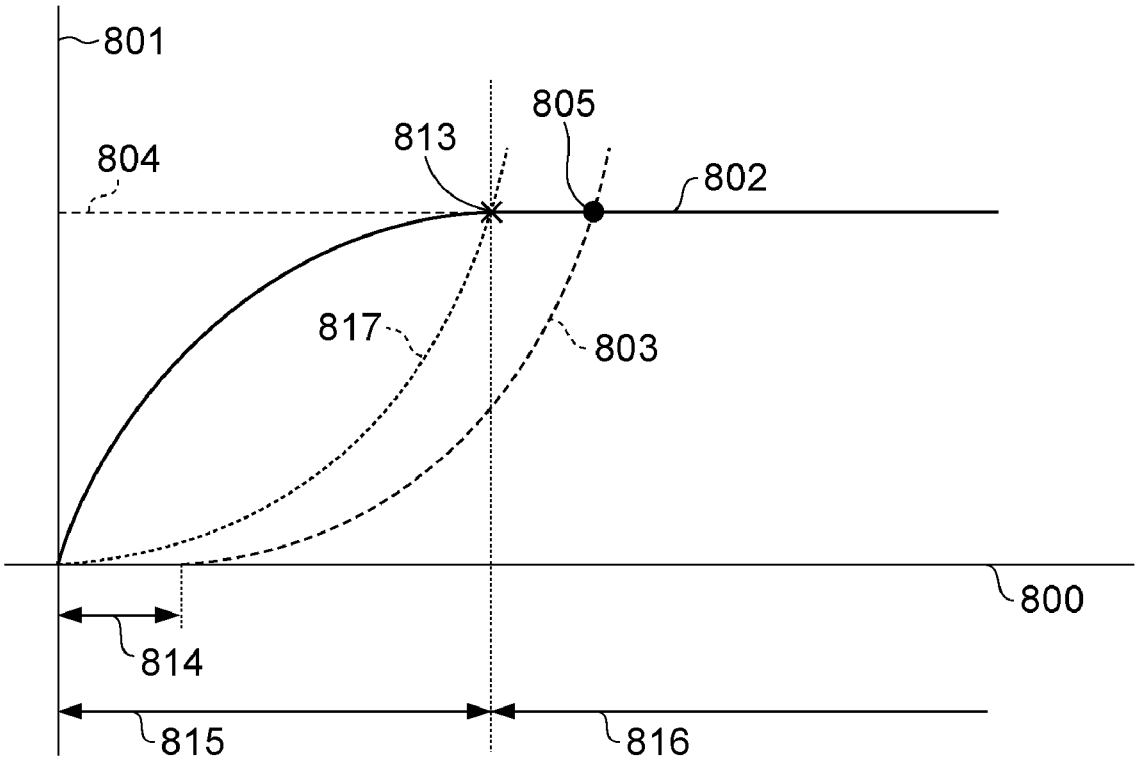
FIG. 8 is a diagram used to describe operation points at the time of diode-connection.

In order to pass a predetermined drain current (Ids) through a TFT, a gate-to-source voltage (Vgs) is generally required to be equal to or larger than a threshold voltage (Vth) of a driving TFT. In the case of a low-temperature polysilicon TFT, Vth is usually approximately 1 to 3V. A curve 802 shown in FIG. 8 represents a drain-to-source voltage (Vds) dependency of Ids of a TFT having complete saturation characteristics in a state in which Vgs is maintained constant (Vgs>Vth).

In a non-saturation region 815 (Vds≦Vgs−Vth), it is generally known that Ids increases with Vds in accordance with the following equation 1.

$$Ids=k\{2(Vgs-Vth)-Vds\}\cdot Vds \qquad \text{Equation 1}$$

Here, k denotes a constant determined by the configuration of a TFT or the characteristics of a semiconductor used. Equation 1 corresponds to a quadratic curve in which the maximum point is a saturation drain voltage 813 (=Vgs−Vth). The maximum value (saturation drain current) of Ids is obtained using the following equation 2.

$$Ids=k(Vgs-Vth)^2 \qquad \text{Equation 2}$$

A locus 817 represents the locus of the saturation drain voltage 813 when Vgs is changed. The saturation drain voltage is approximately 5 to 10V when high-luminance display is performed. In a saturation region 816 (Vds>Vgs−Vth), Ids is a constant value obtained by Equation 2, and depends on Vgs, but does not depend on Vds.

Accordingly, in order to make Ids conform to a predetermined signal current 804 in the image display period, an operation point is required to be in the saturation region 816. The minimum Vds required for that purpose may be lower than Vgs by Vth from the viewpoint of the definition of the saturation drain voltage 813. However, since the first switch 109 is closed and Vds is equal to Vgs when diode-connection is performed, a first operation point 805 larger than the saturation drain voltage 813 by Vth has to be added. Accordingly, the voltage and current characteristics of the driving TFT at the time of diode-connection correspond to a curve 803 obtained by shifting the locus 817 of the saturation drain voltage by Vth in a high-voltage direction. Conversely, if Vds is lowered to the saturation drain voltage 813 during the diode-connection, Vgs is also lowered and Ids becomes lower than the signal current 804. As a result, a signal cannot be accurately written.

If Vgs and Vds can be separately set, Vds can be lowered to the saturation drain voltage 813 with Vgs maintained. In order to feed the signal current 604 from one of the signal current sources 104 in FIGS. 6A and 6B, one of the signal current sources 104 is required to output a voltage that is equal to the sum of the Vds 606 of the driving TFT and the voltage drop 608 across the organic EL device 106 when a signal current flows. However, if Vds can be lowered, the maximum output voltage required for one of the signal current sources 104 can be lowered.

First Embodiment

A circuit according to a first embodiment of the present invention which is based on the above-described concepts will be described. The same reference numerals are used for components having the same functions as those of FIG. 3.

Figure 1:
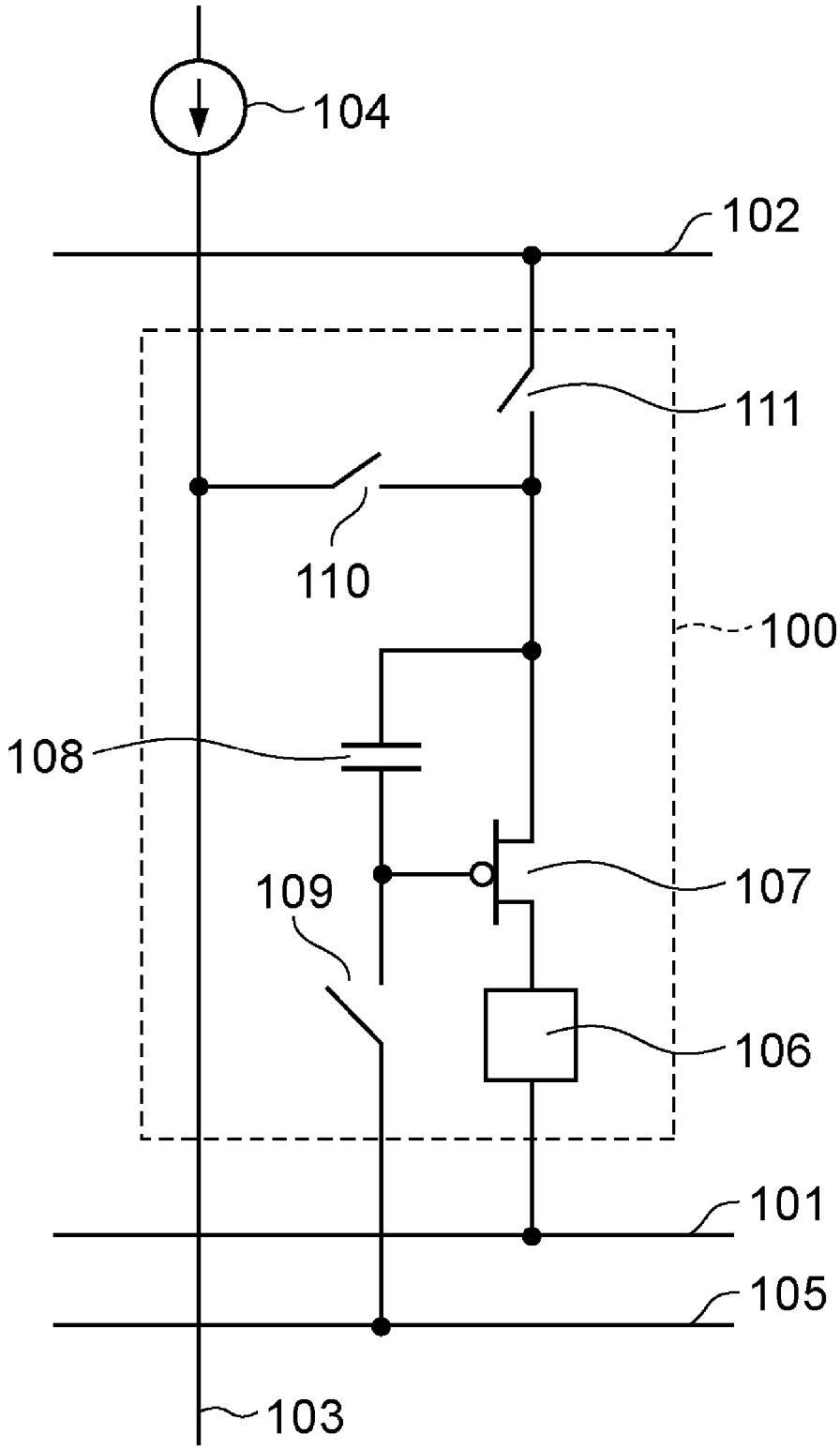
FIG. 1 is a diagram used to describe an organic EL display apparatus according to a first embodiment of the present invention by focusing on a pixel circuit.

An organic EL device and a driving circuit therefor in FIG. 1 include the following components: the organic EL device 106 having two terminals, an anode and a cathode; the driving transistor (TFT) 107 having three terminals, a gate, a source, and a drain; the voltage maintaining unit 108 configured with a capacitor disposed between the gate and the source of the driving transistor; one of the first constant voltage sources (V1) 101, one of the second constant voltage sources (V2) 102, and one of the third constant voltage sources (V3) 105, each of which maintains a fixed potential; one of the signal current sources 104 for providing a signal current; the first switch 109 disposed between the gate of the driving transistor 107 and one of the third constant voltage sources 105; the second switch 110 disposed between the source of the driving transistor 107 and one of the signal current sources 104; and the third switch 111 disposed between the source of the driving transistor 107 and one of the second constant voltage sources 102. In addition to the above-described components, the organic EL device and the driving circuit therefor include an opening and closing control portion (not shown) for controlling opening and closing of the first to third switches.

The drain of the driving transistor 107 is connected to the anode of the organic EL device, and the cathode of the organic EL device is connected to the first constant voltage source.

The differences between the circuits shown in FIGS. 1 and 3 are that in FIG. 1 a third constant voltage source 105 is disposed so as to provide a potential at the gate of the driving TFT 107, which is different from a potential for the drain thereof, and the first switch 109 switches between connection and disconnection of the third constant voltage source 105.

The driving TFT 107 shown in FIG. 1 is a p-channel TFT. However, as will be described later in a second example with reference to FIG. 14, an n-channel TFT may be used.

Figure 2:
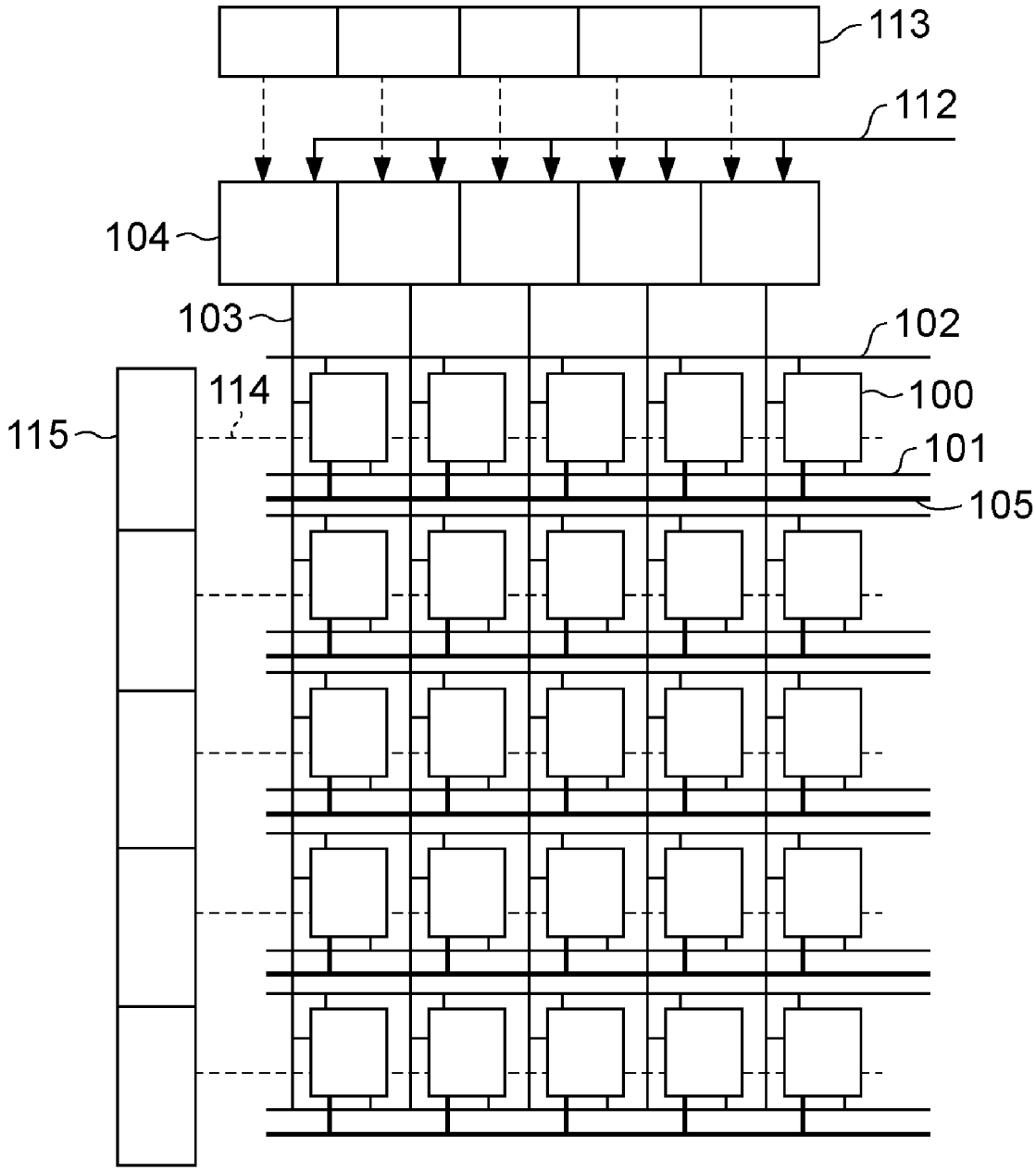
FIG. 2 is a diagram used to describe an entire configuration of an organic EL display apparatus according to an embodiment of the present invention including driving circuits.

FIG. 2 shows an entire configuration of an organic EL display apparatus in which the organic EL devices and the driving circuits (the combinations of them are referred to as pixel circuits) shown in FIG. 1 are arranged in a matrix form.

In FIG. 2, each of the pixel circuits 100 is connected to the first constant voltage source 101, the second constant voltage source 102, and the third constant voltage power source 105. Control lines, each of which controls the first to third switches included in one of the pixel circuits 100, are disposed as the scanning lines 114. The vertical shift register 115 for outputting signals to the scanning lines, the signal lines 103 each of which is provided in a column, the signal current sources 104 each of which is provided in a column, the image signal line 112 for transmitting image signals to the signal current sources, and the horizontal shift register 113 that outputs timing pulses used for sampling of image signals are disposed around a matrix pixel arrangement.

Figure 17:
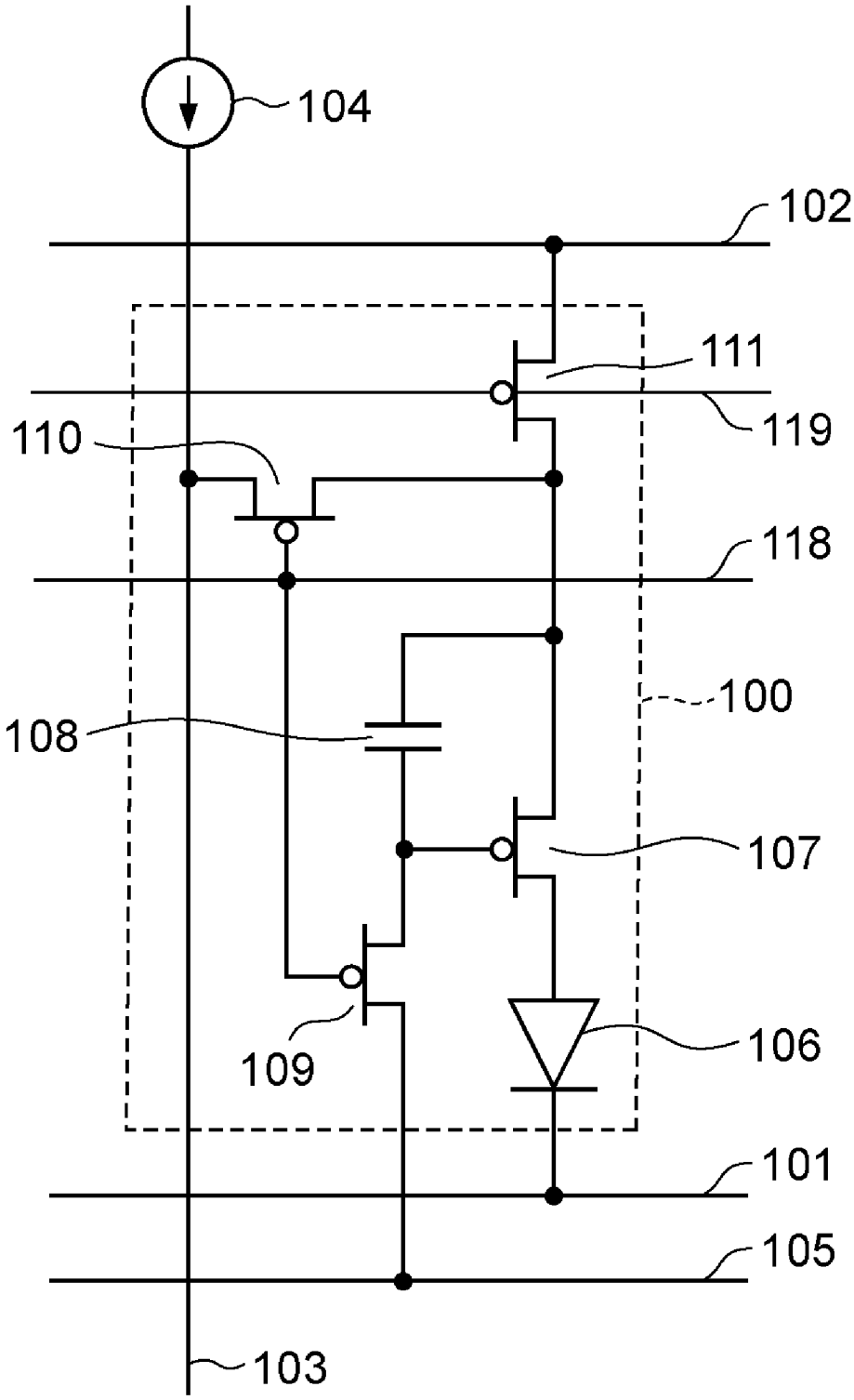
FIG. 17 is a diagram used to describe a driving circuit included in an organic EL display apparatus of a fourth example.

In FIG. 2, only one of the scanning lines 114 is provided in a row. However, a plurality of scanning lines may be provided in each row. Specific examples of this case will be described later in a third example (FIG. 15) and a fourth example (FIG. 17).

The circuit shown in FIG. 1 operates in accordance with the sequences shown in FIG. 5. FIG. 5 shows the following in one of the pixel circuits 100: control signals 504, 505, and 506 for the first switch 109, the second switch 110, and the third switch 111; the gate potential 507 based on a source potential (dotted line) of the driving TFT 107; and a time change in the drain current 508. Each switch is turned on (connected) at a high level and is turned off (opened) at a low level.

A period 500 or 501 for displaying a single image includes the signal write period 502 and the image display period 503.

In the image display period 503, the first switch 109 and the second switch 110 are in an off state, that is, are open, and the third switch 111 is in an on state, that is, is connected. At that time, the source and the drain of the driving TFT 107 and the anode and the cathode of the organic EL device 106 are connected in series between one of the first constant voltage sources 101 and one of the second constant voltage sources 102, whereby a current path including these terminals is created. At that time, the gate-to-source current of the driving TFT 107 passes between the anode and the cathode of the organic EL device 106, thereby causing the organic EL device 106 to emit light.

The value of this current is determined by a gate-to-source voltage of the driving TFT 107. The gate-to-source voltage of the driving TFT 107 is set in the signal write period 502 antecedent to the image display period 503.

In the signal write period 502, first, the third switch 111 is turned off, so that the series connection between the driving TFT 107 and the organic EL device 106 is separated at the source of the driving TFT 107. At the same time, the first switch 109 and the second switch 110 are turned on, so that the gate of the driving TFT 107 is connected to one of the third constant voltage sources (V3) 105 and the source thereof is connected to one of the signal current sources 104. At that time, a signal current passes through between the source and the drain of the driving TFT 107, so that a gate-to-source voltage of the driving TFT 107 occurs in accordance with the signal current. This voltage is maintained in the capacitor 108 disposed between the gate and the source of the driving TFT 107.

Subsequently, the first switch 109 is opened so as to disconnect the gate of the driving TFT 107 from one of the third constant voltage sources (V3) 105. At the same time, or after some delay, the second switch 110 is turned off and the third switch 111 is turned on. Consequently, the source of the driving TFT 107 is disconnected from one of the signal current sources 104, and the driving TFT 107 and the organic EL device 106 are reconnected in series.

Figure 9A:
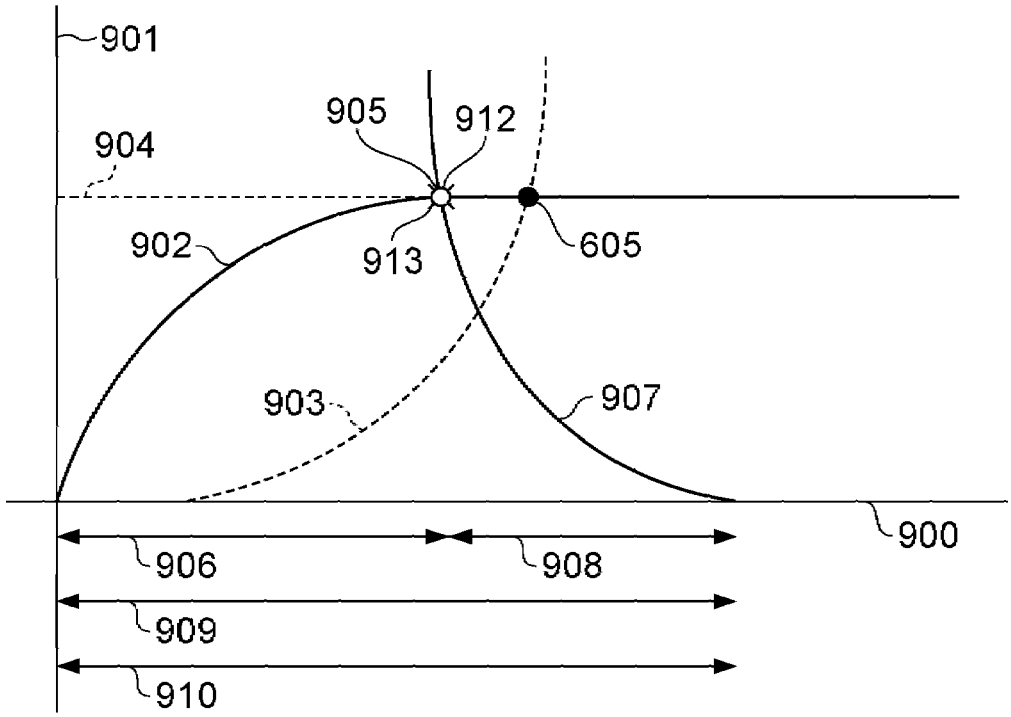
FIGS. 9A and 9B are diagrams used to describe operations of a driving circuit using TFTs having complete saturation characteristics in an organic EL display apparatus according to an embodiment of the present invention.
Figure 9B:
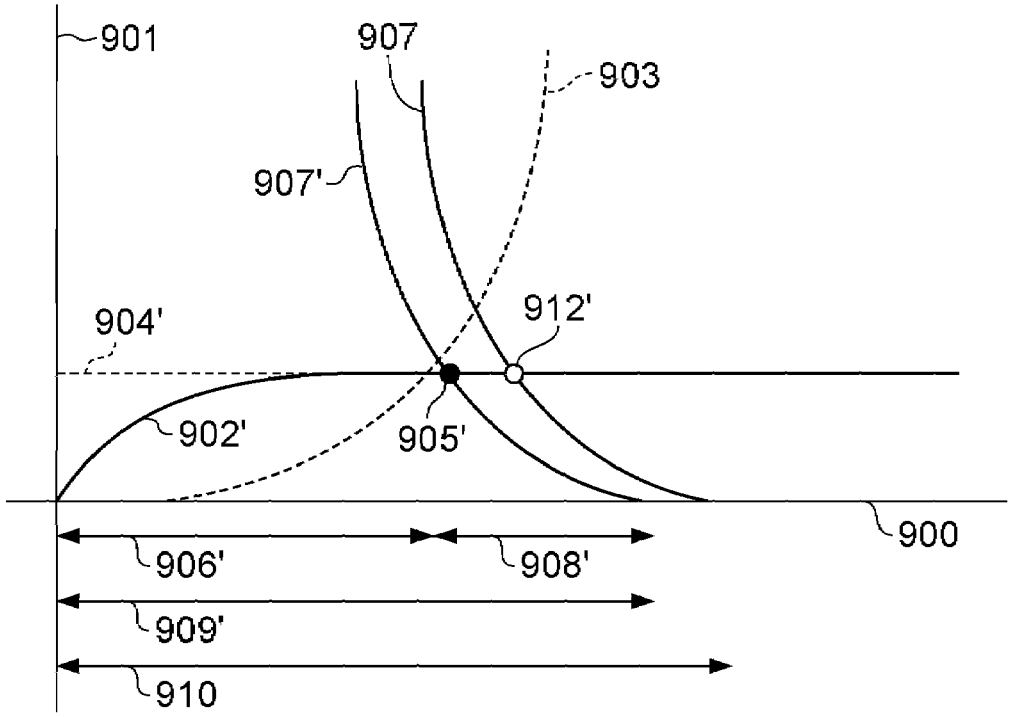

FIG. 9A shows the operation of the circuit shown in FIG. 1 when high-luminance display is performed. FIG. 9B shows the operation of the circuit shown in FIG. 1 when lo-luminance display is performed. First, description will be made with reference to FIG. 9A. In the signal write period 502, the first switch 109 and the second switch 110 are also closed and the third switch 111 is also open. Since the potential of one of the third constant voltage sources 105 is applied to the gate of the driving TFT 107, a difference between the voltage of the gate of the driving TFT 107 and a voltage output from one of the signal current sources 104 is Vgs. In a saturation region, Ids of a TFT is determined by Vgs. Accordingly, one of the signal current sources 104 outputs a voltage allowing Ids to be equal to a signal current 904. Vgs at that time is written into the voltage maintaining unit 108. The written potential is not changed after the first switch 109 is opened even if potentials of the first to third feeders are changed and a potential drop occurs near the pixel circuit due to a wiring resistance in the display apparatus.

A voltage drop 908 occurs between electrodes of the organic EL device 106 in accordance with the signal current 904. If display is performed at the maximum luminance, the voltage drop 908 is typically approximately 3 to 5V. Accordingly, Vds of the driving TFT 107 is obtained by subtracting the voltage drop 908 of the organic EL device from an output voltage 909 of one of the signal current sources 104. However, in order to ensure an operation in the saturation region, Vds is required to be larger than a saturation drain voltage 913. FIG. 9A shows a case in which Vds and the saturation drain voltage 913 are matched. This matching point is defined as a typical first operation point 905 of the present invention. In the circuit shown in FIG. 1, Vds and Vgs are independent of each other different from the circuit shown in FIG. 3. Accordingly, Vgs can be controlled by the potential of one of the third constant voltage sources 105. In order to achieve the state shown in FIG. 9A, the potential of the third feeder is required to be closer to the potential of the second feeder on the basis of the potential of the first feeder. More specifically, the potential of the third feeder is obtained by subtracting a threshold voltage of the driving TFT from the voltage drop of the organic EL device and adding the obtained number to the potential of the first feeder.

As the signal current 904 increases, a corresponding saturation drain voltage increases. An assumed maximum saturation drain voltage becomes therefore a value corresponding to an assumed maximum signal current. If a line 904 shown in FIG. 9A denotes the assumed maximum signal current, a double sided arrow 909 that denotes the sum of a saturation drain voltage of the driving TFT and a voltage drop of the organic EL device corresponds to the assumed maximum value of a voltage at the output terminal of one of the signal current sources 104. This value is lower than the first operation point 605 of the known current programming circuit shown in FIG. 3 by the threshold voltage Vth of the driving TFT 107. That is, according to an embodiment of the present invention, the maximum voltage at the output terminal of one of the signal current sources 104 can be lowered by the threshold voltage Vth of the driving TFT compared with the known circuit.

For example, in the known circuit, if the saturation drain voltage of the driving TFT is 6V, the threshold voltage is 2V, and the voltage drop of the organic EL device is 4V, the signal current source had to output a voltage of 12V as the maximum voltage. However, the maximum voltage at an output terminal of the signal current source required in the typical example of the present invention is only 10V. The first operation point may be another point between the first operation point 905 shown in FIG. 9A and the first operation point 605 shown in FIG. 6A if the point can produce an improvement effect and accommodate variations in characteristics of the organic EL device. That is, the maximum value at the output terminal of the signal current source may be equal to or larger than the sum of the saturation drain voltage of the driving TFT and the voltage drop of the organic EL device when the maximum signal current flows, and may be smaller than the sum of the saturation drain voltage of the driving TFT, the voltage drop of the organic EL device, and the threshold voltage when the maximum signal current flows. Accordingly, the potential of the third feeder may be equal to or larger than a number obtained by subtracting the threshold voltage of the driving TFT from the voltage drop of the organic EL device when the maximum signal current flows, and may be smaller than the voltage drop of the organic EL device.

Figure 10A:
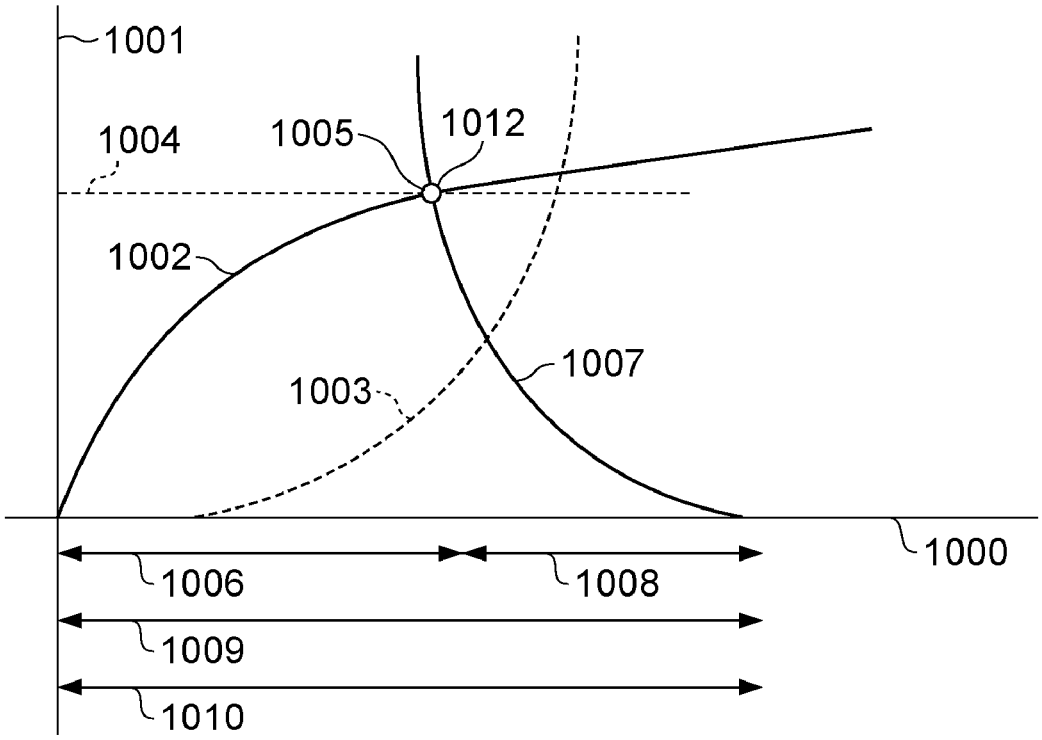
FIGS. 10A and 10B are diagrams used to describe operations of a driving circuit using TFTs having incomplete saturation characteristics in an organic EL display apparatus according to an embodiment of the present invention.
Figure 10B:
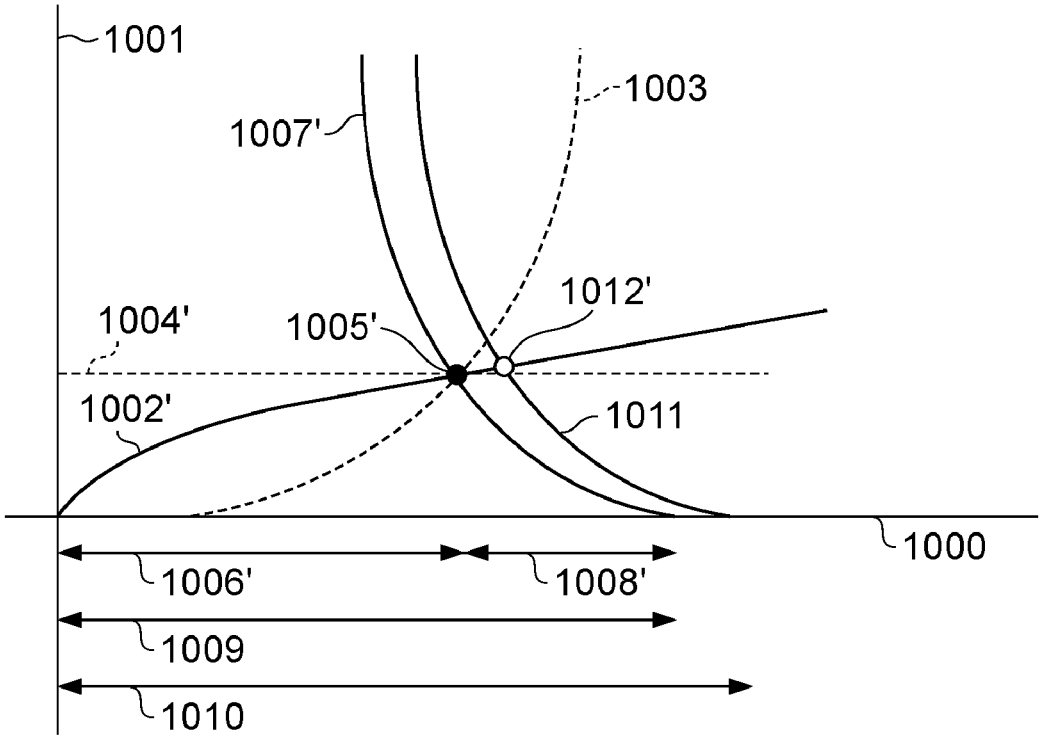

If a power supply voltage 910 and the output voltage 909 of the signal current source are matched when image display is performed, power consumption at the time of image display can be reduced. In addition, in the case of the display at the maximum luminance shown in FIG. 9A, a second operation point 912 is matched with the first operation point 905, and the shift of the operation point does not occur. In the case of the display at low luminance, the shift of the operation point from 905' to 912' occurs, but the range of the shift is smaller than that of the shift from 605' to 612' shown in FIG. 6B. Accordingly, as shown in FIG. 10A, in the case of display at the maximum luminance, if the driving TFT has incomplete saturation characteristics, operation points 1005 and 1012 are matched, the shift of the operation point does not occur, and a driving current and a signal current 1004 are matched. In the case of display at low luminance shown in FIG. 10B, the range of the shift of the operation point from 1005' to 1012' is smaller than that of the shift from 705' to 712' in the known current programming circuit shown in FIG. 7B. The error of the driving current can be reduced, and the accuracy of image display when a driving TFT with incomplete saturation characteristics is used can be improved.

Thus, a gate-to-source voltage at the time of programming is maintained by setting a gate voltage at the time of the programming as a fixed potential irrespective of a signal current and then disconnecting a gate from a constant voltage source. When image display is performed, a source terminal is disconnected from a signal current source and is then connected to a constant power supply voltage of a second feeder. Consequently, a current flows from the source terminal to a drain terminal in accordance with the gate-to-source voltage, whereby an organic EL device can be driven. According to this method, the fixed potential of the second feeder can be set to a voltage that is the sum of a saturation drain voltage of a TFT and a voltage across the organic EL device, both of which are obtained when the maximum signal current flows within the range of a change in the signal current. This power supply voltage is lower than a power supply voltage obtained using the known driving method in which a TFT is diode-connected at the time of current programming by a threshold voltage. Consequently, power consumption can be reduced.

Second Embodiment

A circuit according to another embodiment of the present invention will be described with reference to FIG. 11. The same reference numbers are used for components having the same functions as those of FIG. 1.

Figure 11:
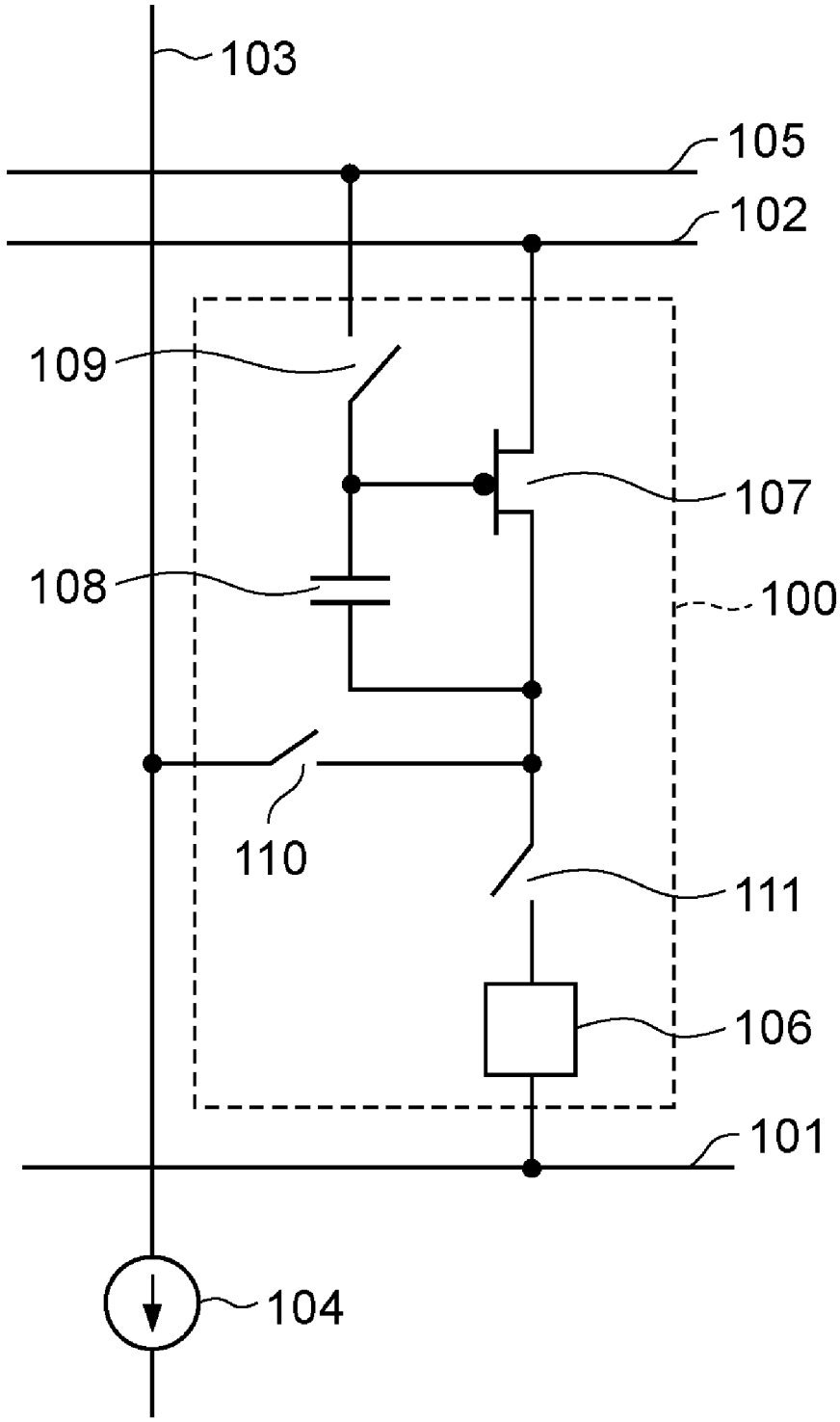
FIG. 11 is a diagram used to describe a driving circuit included in an organic EL display apparatus according to a second embodiment of the present invention by focusing on a pixel circuit.

In FIG. 11, at the time of light emission, the source of the driving TFT 107 is connected to the anode of the organic EL device 106 and the drain of the driving TFT 107 is connected to one of the second constant voltage sources 102. The driving TFT 107 is an n-channel TFT, but may be a p-channel TFT. If a p-channel TFT is used, voltage settings of the first and second constant voltage sources are interchanged, and the terminals of the organic EL device 106 are also interchanged.

Figure 12:
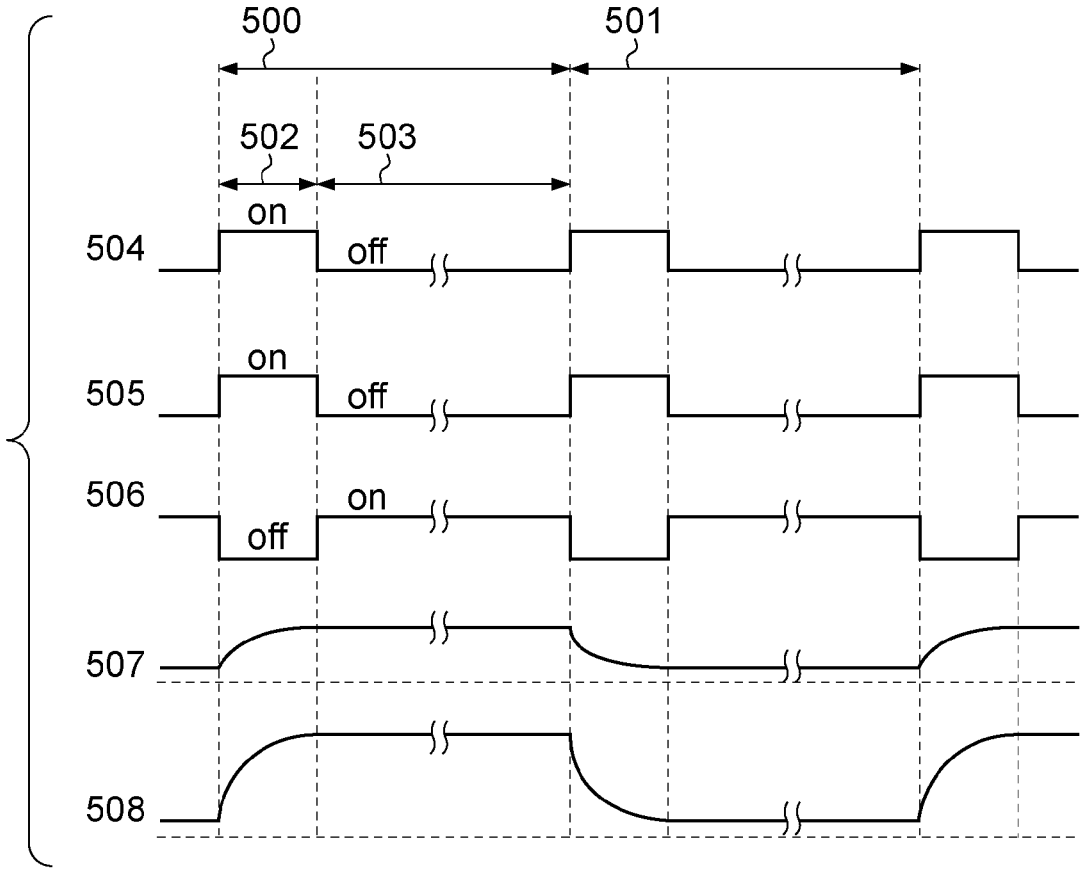
FIG. 12 is a diagram used to describe driving sequences of a driving circuit included in the organic EL display apparatus according to the second embodiment of the present invention.

The circuit shown in FIG. 11 operates in accordance with sequences shown in FIG. 12. In FIG. 12, the same reference numerals are used for items having the same descriptions as those of FIG. 5. Each of the first to third switches performs the same operations as those described with reference to FIG. 5. In this case, the driving TFT 107 is an n-channel TFT. Accordingly, as a driving current increases, a gate-to-source potential increases differently from the case shown in FIG. 5.

The operation of the circuit shown in FIG. 11 when high-luminance display is performed will be described with reference to FIG. 9A. The operation of the circuit shown in FIG. 11 when low-luminance display is performed will be described with reference to FIG. 9B. In this case, since the driving TFT 107 is an n-channel TFT, a direction in which a potential decreases on the basis of a potential of the second constant voltage source is defined as a positive direction in the voltage axis.

First, in the case of high-luminance display shown in FIG. 9A, in the signal write period 502, the first switch 109 and the second switch 110 are closed and the third switch 111 is open. Vgs of the driving TFT 107 is determined so that the saturation value of Ids is matched with the signal current 904 using equation 2. The source-to-drain voltage Vds of the driving TFT 107 is determined using the following equation 3.

$$Vds = (\text{The potential of the second constant voltage source}) - (\text{The potential of the third constant voltage source}) + Vgs \qquad \text{Equation 3}$$

This voltage Vds is defined as a first drain-to-source voltage. This voltage Vds is required to be in the saturation region of the driving TFT 107. Accordingly, the potential of the third constant voltage source can be determined so that Vds obtained when the maximum signal current flows is matched with the first operation point 905 shown in FIG. 9A. The third feeding potential point 913 shown in FIG. 9A is a point determined in such a manner.

In the image display period, the first switch 109 is opened. After that, the potential written in the voltage maintaining unit 108 is not changed even if the potentials of the first to third constant voltage sources are changed and a potential drop occurs near the pixel circuit due to a wiring resistance in the display apparatus. Since the second switch is opened and the third switch is closed, the source of the driving TFT 107 is disconnected from one of the signal lines 103. However, since Vgs is maintained, the shape of a curve is not changed. The organic EL device 106 and the driving TFT 107 are connected in series between one of the first constant voltage sources 101 and one of the second constant voltage sources 102. Since the signal current 904 also passes through the organic EL device, the voltage drop 908 occurs between electrodes thereof in accordance with the characteristics 907. Accordingly, Vds of the driving TFT 107 is obtained using the following equation 4.

$$Vds = (\text{The power supply voltage 910}) - (\text{The voltage drop 908 of the organic EL device}) \qquad \text{Equation 4}$$

This voltage Vds is defined as a second drain-to-source voltage.

When the first and second drain-to-source voltages are matched, even if a transistor has incomplete saturation characteristics, a current value at the time of programming and a current value at the time of light emission can be matched. FIG. 9A shows the case in which the first and second operation points are the same.

The potential of the third constant voltage source is obtained using equation 5 based on equations 3 and 4 on the basis of GND as follows.

$$(\text{The gate-to-source voltage Vgs when a predetermined current flows}) + (\text{The voltage drop 908 in the organic EL device at that time}) \qquad \text{Equation 5}$$

This equation can be also represented as (the saturation drain voltage 913+the threshold voltage+the voltage drop 907 in the organic EL device) on the basis of conditions required for a saturation operation of the driving transistor. The saturation drain voltage 913 and the voltage drop 907 in the organic EL device depend on the level of the signal current 904. After the signal current 904 is determined in accordance with a luminance level used for display, the value of the saturation drain voltage 913 and the value of the voltage drop 907 in the organic EL device are determined as represented by the double sided arrows 906 and 908 in FIG. 9A. The potential 903 of the third constant voltage source is obtained by using these values in equation 5.

The maximum potential of the third constant voltage source is calculated by obtaining a current with the maximum luminance level to be used for display as the signal current 904 and using equation 5. If the power supply voltage is 15V, Vgs at the time of the maximum luminance is 7V, and the voltage drop of the organic EL device is 6V, the third feeding potential becomes 13V using equation 5. An EL current at that time is in exact agreement with the programming current.

When the third feeding potential is determined and fixed in such a manner, if the luminance is lowered, the first drain-to-source voltage obtained by equation 3 decreases and the second drain-to-source voltage obtained by equation 4 increases. They become different from each other. That is, the operation point at the time of programming and the operation point at the time of light emission become different from each other. If the transistor has incomplete saturation characteristics, the programming current is not matched with the EL current.

FIG. 9B shows the above-described case. A first operation point 905' is set to a potential that is lower than a third feeding potential 920 by the gate-to-source voltage Vgs determined by the signal current 904'. A second operation point 912' is set as a point of an intersection of the same organic EL characteristics curve as that shown in FIG. 9A and a line depicting the signal current 904'.

In the case of the known circuit shown in FIG. 3, if the signal current is changed, the second operation point moves downward along the diode-connection current and voltage characteristics curve. However, in this case, the potential of the third constant voltage source is fixed. The first operation point 905' shown in FIG. 9B is on the right side of the first operation point 905 show in FIG. 9A. Accordingly, the difference between the first operation point 905' and the second operation point 912' at the time of the low-luminance display is smaller compared with the known circuit shown in FIG. 3.

If the signal current decreases, Vgs becomes 5V, and the voltage drop of the organic EL device becomes 4V while the potential of the third constant voltage source is 13V, the first drain-to-source voltage becomes 7V and the second drain-to-source voltage becomes 11V. That is, Vds increases by +4V. If a transistor has incomplete saturation characteristics, and if Ids increases at the ratio of 3%/V in accordance with Vds in a saturation region, a luminance error of 12% occurs. This value is smaller than a luminance error of 18% in the circuit shown in FIG. 3 which has been described with reference to FIGS. 7A and 7B.

Conversely, If the potential of the third constant voltage source is optimized for the signal current 904' in FIG. 9B, that is, the first and second operation points are matched, since Vgs is 5V and the voltage drop of the organic EL device is 4V, an optimum value becomes 9V using equation 5. Accordingly, an image can be accurately displayed at this luminance level.

Here, the signal current is raised to the level of the signal current 904 with the above-described settings maintained. Since Vgs is 7V and the voltage drop of the organic EL device is 6V, the first drain-to-source voltage becomes 13V using equation 5 and the second drain-to-source voltage becomes 9V using equation 4. That is, Vds decreases by 4V. If Ids of a TFT increases at the ratio of 3%/V in accordance with Vds, a luminance error of −12% occurs.

In the case of a general image, it is desirable that optimization be performed for the luminance of a geometric average of the maximum value and the minimum value. A case in which optimization is performed for the luminance level that is approximately one-third of the maximum luminance level will be shown in FIGS. 10A and 10B. Here, since Vgs is 6V and the voltage drop of the organic EL device is 5V, an optimum value becomes 11V. A first drain-to-source voltage 1005 and a second drain-to-source voltage 1012 are matched at this luminance level (in this drawing, they are slightly unmatched for the sake of clarity). If a signal current is more than three times as large as a signal current 1004 with the above-described settings maintained, Vds increases by 2V and the luminance increases by 6% in the image display period. The signal current is reduced to less than one-third thereof, Vds decreases by 2V and the luminance decreases by 6%. However, all in all, the luminance error can be improved. As a method of obtaining the average of the maximum and minimum values, arithmetic average may be used instead of geometric average. Alternatively, a value that occurs with a high frequency may be chosen.

As described previously, the luminance error due to incomplete saturation characteristics of a driving TFT cannot be completely prevented. However, for example, in the case of a high-luminance document image having a white background, settings described in the case of high-luminance display can be performed. In the case of a low-luminance document image having a gray background, settings described in the case of low-luminance display can be performed. Consequently, luminance nonuniformity is suppressed. In the case of an image with an average luminance level, settings described with reference to FIGS. 9A and 9B can be performed. Consequently, the display accuracy of an image with an average luminance level can be improved. As is apparent from equation 5, this change does not depend on a power supply voltage, and can be easily performed only by controlling the potential 903 of the third constant voltage source.

In the circuits shown in FIGS. 1 and 11, when a current is provided for an organic EL device, the source and the drain of a driving transistor and the anode and the cathode of the organic EL device are connected in series between constant voltage sources. A current passes through a current path, which connects the source and the drain of the driving transistor and the anode and the cathode of the organic EL device, in accordance with a voltage between the gate and the source of the driving transistor, whereby the organic EL device emits light. A capacitor for maintaining a voltage is disposed between the gate and the source of the driving transistor. Such a configuration is the same as that of the known circuit shown in FIG. 3.

However, as described previously, at the time of programming, that is, when generating a voltage between the gate and the source of the driving transistor in accordance with a signal, a method different from that used by the circuit shown in FIG. 3 is performed. That is, the potential of the gate of the driving transistor is set as a fixed potential that does not depend on a signal current, the series connection at the time of the above-described light emission, the series connection being composed of the source and the drain of the driving transistor and the anode and the cathode of the organic EL device, is separated at the source terminal of the driving transistor, and the source terminal is connected to a current signal source that is a data line. The capacitor is always connected between the source and the gate. If a signal current passes between the source and the drain of the driving transistor, a voltage occurs between the gate and the source in accordance with the value of the signal current. In this state, the gate is disconnected from a constant voltage power supply so as to maintain a gate-to-source voltage.

In the first circuit shown in FIG. 1, the series connection at the time of light emission is a connection in which the drain of the driving transistor, that is, a terminal other than a terminal connected to the gate via the capacitor, is directly connected to the anode terminal of the organic EL device. At that time, the source of the driving transistor and the capacitor are connected to the second constant voltage source. The cathode of the organic EL device is fixedly connected to the first constant voltage source.

If the polarity of the driving transistor is reversed, that is, the driving transistor is an n-channel transistor, the direction of a current is reversed. Accordingly, the anode and the cathode of the organic EL device in FIG. 1 are interchanged.

In the second circuit shown in FIG. 11, the series connection at the time of light emission is a connection in which the source of the driving transistor and the anode of the organic EL device are directly connected. At that time, the drain of the driving transistor is fixedly connected to the second constant voltage source. The cathode of the organic EL device is fixedly connected to the first constant voltage source.

If the polarity of the driving transistor is reversed, that is, the driving transistor is a p-channel transistor, the direction of a current is reversed. Accordingly, the anode and the cathode of the organic EL device in FIG. 11 are interchanged.

According to this method, the fixed potential of the second constant voltage source can be set to a voltage that is the sum of a saturation drain voltage of a TFT and a voltage across the organic EL device, both of which are obtained when the maximum signal current within the range of a change in the signal current flows. This power supply voltage is lower than a power supply voltage obtained using the known driving method in which a TFT is diode-connected at the time of current programming by a threshold voltage. Consequently, power consumption can be reduced.

In the following, description will be made by providing specific circuits as examples. First to fourth examples are specific examples of the circuit shown in FIG. 1. Fifth to ninth examples are specific examples of the circuit shown in FIG. 11.

FIRST EXAMPLE

Figure 13:
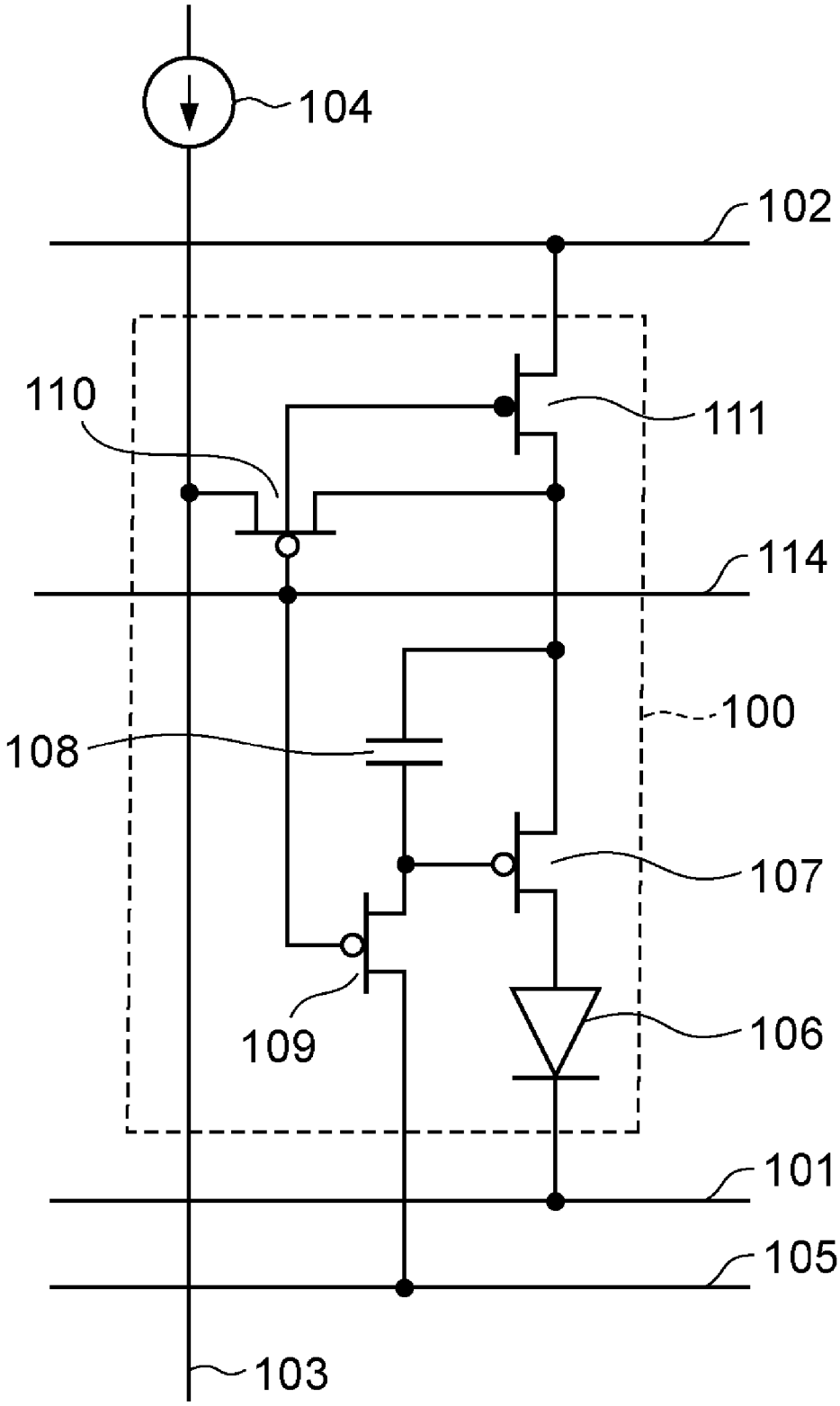
FIG. 13 is a diagram used to describe a driving circuit included in an organic EL display apparatus of a first example.

FIG. 13 shows an example of a circuit according to an embodiment of the present invention which is configured with a low-temperature polysilicon CMOS. In the case of a display apparatus in which a driving circuit is formed on a substrate, and the organic EL device 106 is formed on the driving circuit, the display apparatus can be easily produced by connecting the drain of the driving TFT 107 to the anode of the organic EL device 106 as a pixel electrode and forming a metallic or transparent electroconductive film or the like on the entire top surface as the first constant voltage power sources 101. It is known that the organic EL device 106 included in the display apparatus created in the above-described order has excellent carrier injection characteristics. A voltage drop in the organic EL device is reduced, whereby the maximum output voltage of the signal current source and the power supply voltage can be further reduced.

A p-channel TFT is used for each of the driving TFT, the first switch 109, and the second switch 110, and an n-channel TFT is used for the third switch 111. The gate of each TFT is connected to a corresponding one of the scanning lines 114. When a low-level signal is applied from the vertical shift register 115 to one of the scanning lines 114, the first switch 109 and the second switch 110 are closed and the third switch 111 is opened. When a high-level signal is applied to one of the scanning lines 114, operations of all switches are reversed. Accordingly, the sequences shown in FIG. 5 can be achieved with only one of the scanning lines 114.

SECOND EXAMPLE

Figure 14:
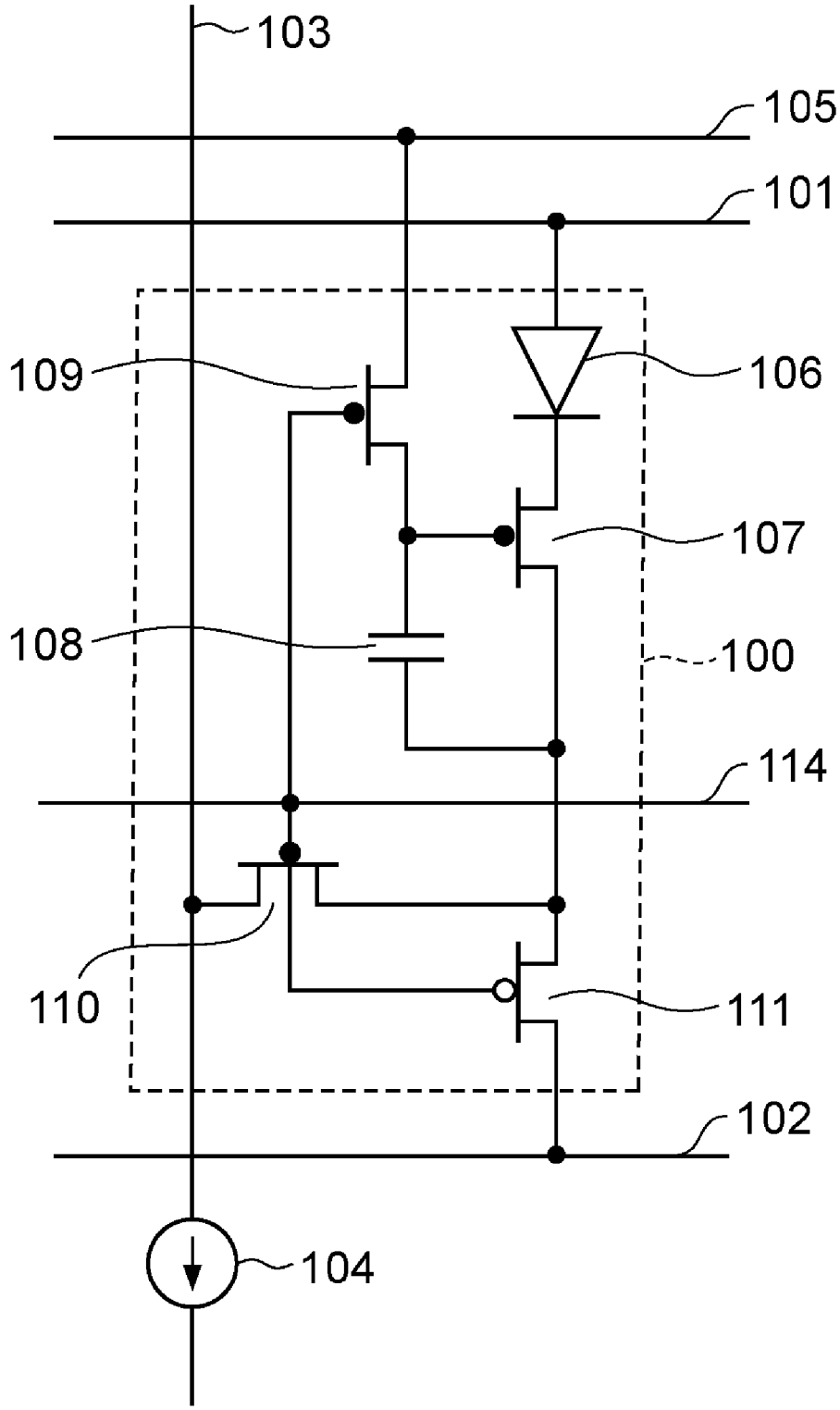
FIG. 14 is a diagram used to describe a driving circuit included in an organic EL display apparatus of a second example.

FIG. 14 shows another example of a circuit according to an embodiment of the present invention which is configured with a low-temperature polysilicon CMOS. Here, a display apparatus can be easily produced by connecting the drain of the driving TFT 107 to the cathode of the organic EL device 106 as a pixel electrode and forming a metallic or transparent electroconductive film or the like on the entire top surface as the first constant voltage power source 101.

An n-channel TFT is used for each of the driving TFT, the first switch 109, and the second switch 110, and a p-channel TFT is used for the third switch 111. The gate of each TFT is connected to a corresponding one of the scanning lines 114. When a high-level signal is applied from the vertical shift register 115 to one of the scanning lines 114, the first switch 109 and the second switch 110 are closed and the third switch 111 is opened. When a low-level signal is applied to one of the scanning lines 114, operations of all switches are reversed. Accordingly, the sequences shown in FIG. 5 can be achieved with only one of the scanning lines 114.

The circuits of the first and second examples individually have an additional component, the third constant voltage power source 105, as compared with a known current programming circuit disclosed in U.S. Pat. No. 6,229,506. However, the number of circuit elements such as TFTs does not increase. Accordingly, the circuits can be easily produced and can be said to be practical circuits.

THIRD EXAMPLE

A capacitor is widely used as the voltage maintaining unit 108 in the circuit shown in FIG. 1. In the sequences shown in FIG. 5, since the first switch 109 is closed in the signal write period 502, a current flows into the voltage maintaining unit 108 and the gate-to-source voltage used to cause a signal current to pass through the drain and the source of the driving TFT is written therein. The written potential is required to be maintained with certainty in the image display period 503.

In the image display period 503, the written potential is not usually changed, because the first switch 109 is opened. However, if the third switch 111 is closed before the first switch 109 is opened and the source of the driving TFT 107 is connected to one of the second constant voltage power sources 102, a current may flow into the voltage maintaining unit 108 and the appropriately written potential may be changed. As shown in FIG. 13, the specification such as a conductivity type of the first switch 109 is often different from that of the third switch 111. State transition periods are therefore different between them. In addition, since a wiring capacity of one of the second constant voltage power sources 102 is different from that of one of the third constant voltage power sources 105, switching may not be appropriately performed.

Figure 15:
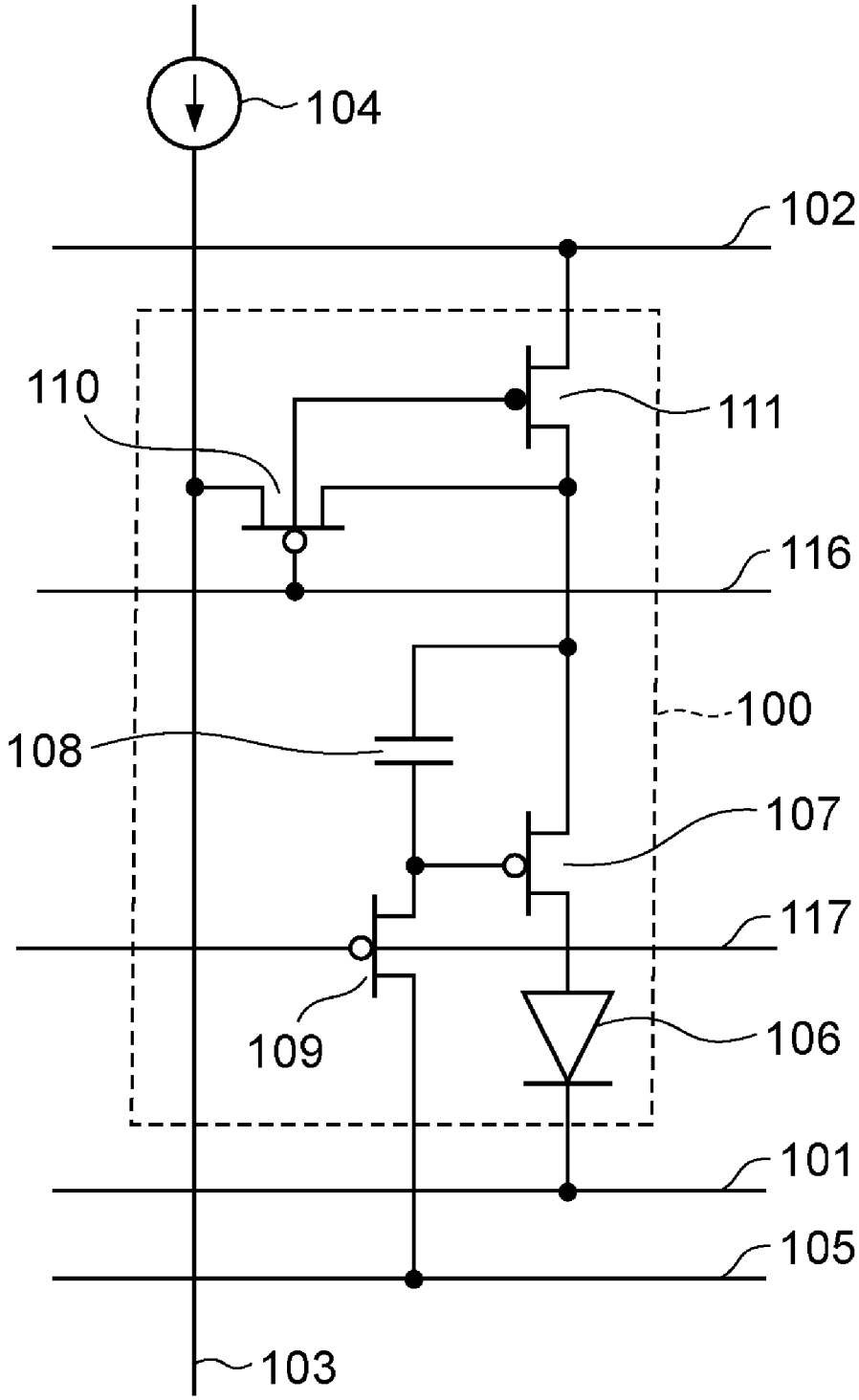
FIG. 15 is a diagram used to describe a driving circuit included in an organic EL display apparatus of a third example.
Figure 16:
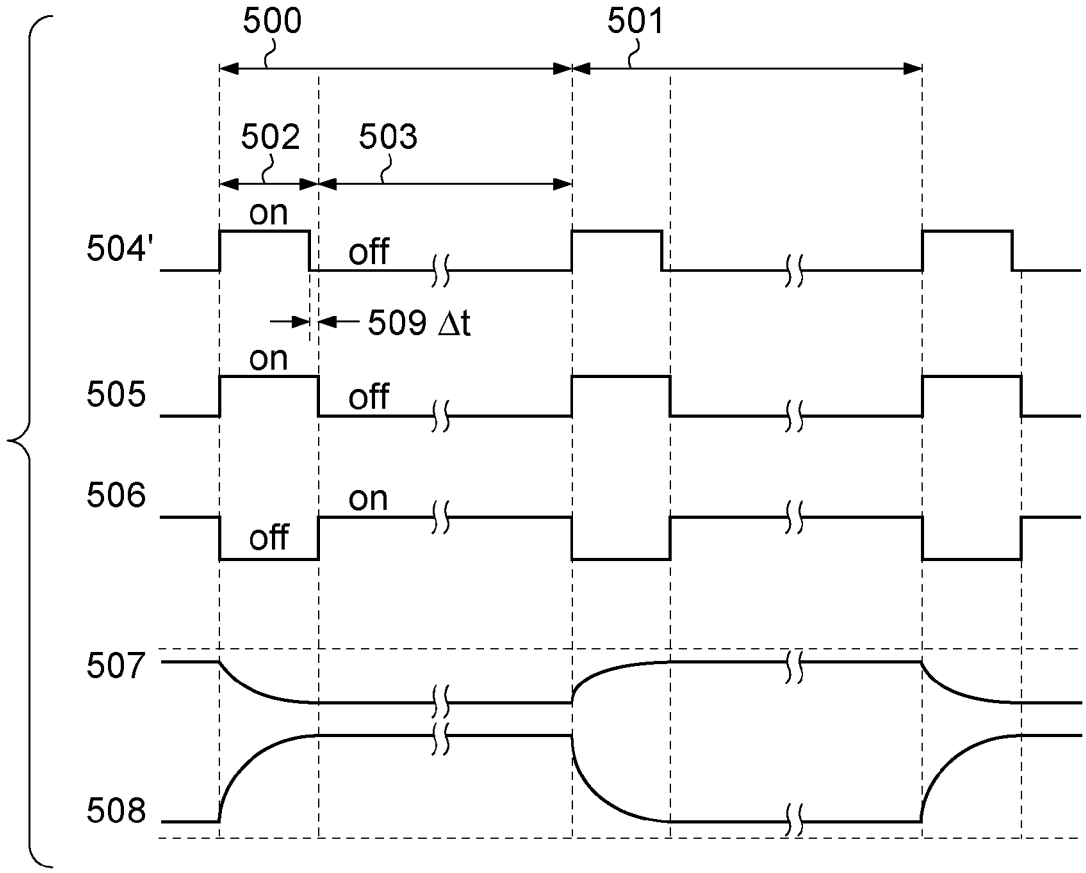
FIG. 16 is a driving timing chart of the organic EL display apparatus of the third example.

FIG. 15 shows an example of a circuit for precluding the possibility of error occurrence and performing switching from the signal write period 502 to the image display period 503 with certainty. A circuit shown in FIG. 15 is created on the basis of the circuit shown in FIG. 13. Circuit elements such as TFTs of the circuit shown in FIG. 15 are the same as those of the circuit shown in FIG. 13. However, in the circuit shown in FIG. 15, a scanning line 117 for the first switch 109 and a scanning line 116 for the second switch 110 and the third switch 111 are separately disposed. Accordingly, as shown in FIG. 16, when the signal write period 502 is changed to the image display period 503, a switching operation 504' of the first switch 109 can precede the switching operation 505 of the second switch 110 and the switching operation 506 of the third switch 111 by a predetermined period $\Delta t$. Alternatively, the switching operations of the second switch 110 and the third switch 111 can follow the switching operation of the first switch 109 after a predetermined period $\Delta t$ delay. Consequently, a current cannot improperly flow into the voltage maintaining unit 108. In addition, in the image display period 503, a driving current can properly flow.

FOURTH EXAMPLE

Like the circuits shown in FIGS. 13 to 15, by using a CMOS, a plurality of switches can be driven in reverse phase in accordance with a signal transmitted from a single scanning line. Conversely, in the case of a polysilicon CMOS, the manufacturing process thereof is complex. In the case of metal oxide semiconductors such as amorphous silicon, ZnO, and InGaZnO, only n-channel TFTs can provide excellent characteristics. In the case of organic semiconductors, only p-channel TFTs can provide excellent characteristics. The above-described circuits cannot cover such cases.

FIG. 17 shows an example of a circuit in which p-channel TFTs are used for all of the driving TFTs 107, the first switch 109, the second switch 110, and the third switch 111. Here, the gates of the first switch 109 and the second switch 110 are connected to a first scanning line 118. On the other hand, the gate of the third switch 111 is connected to a second scanning line 119. Accordingly, the sequences shown in FIG. 5 can be achieved by providing signals having opposite phases to the scanning lines 118 and 119.

Figure 18:
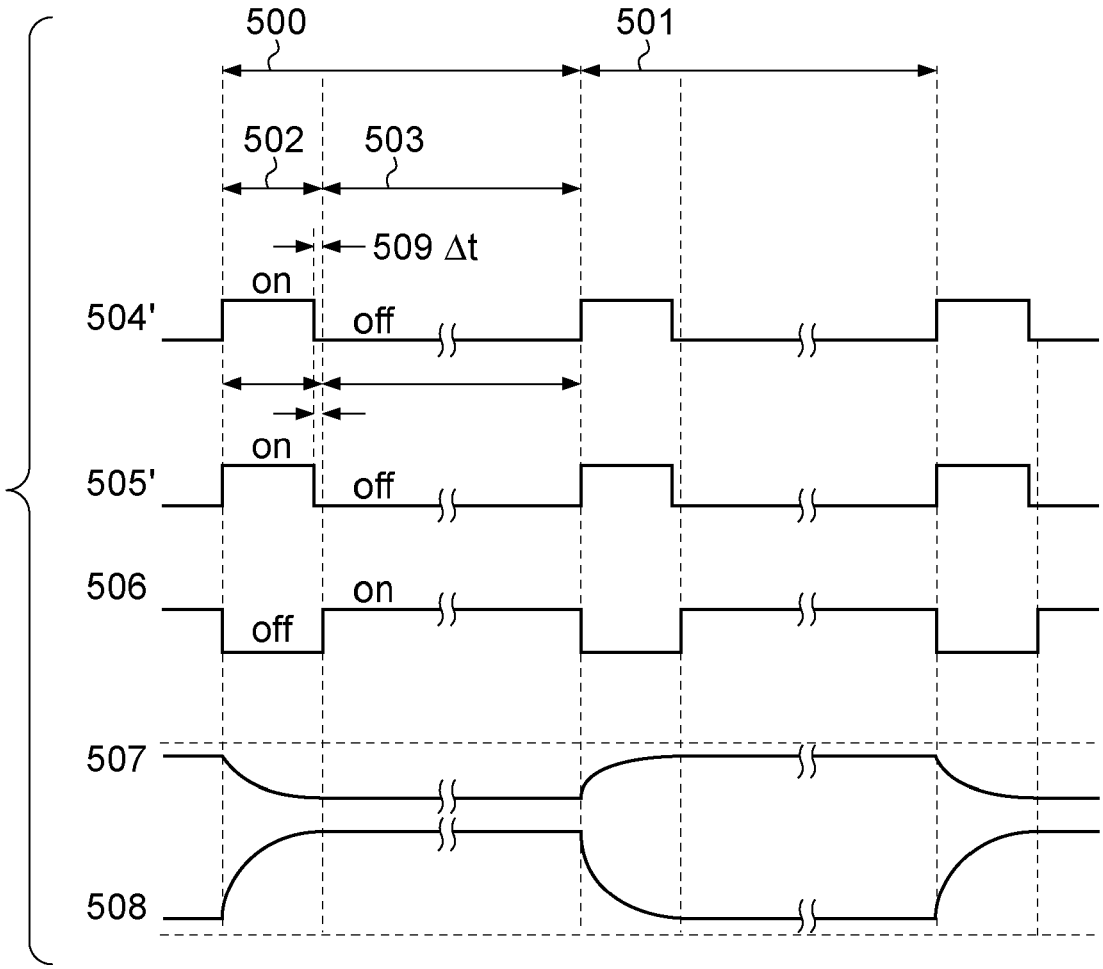
FIG. 18 is a driving timing chart of the organic EL display apparatus of the fourth example.

Furthermore, as shown in FIG. 18, signal switching of the first scanning line 118 precedes signal switching of the second scanning line 119 by a predetermined period Δt. Consequently, like the circuit of the third example shown in FIG. 15, a signal written in the voltage maintaining unit 108 can be accurately maintained.

FIFTH EXAMPLE

Figure 19:
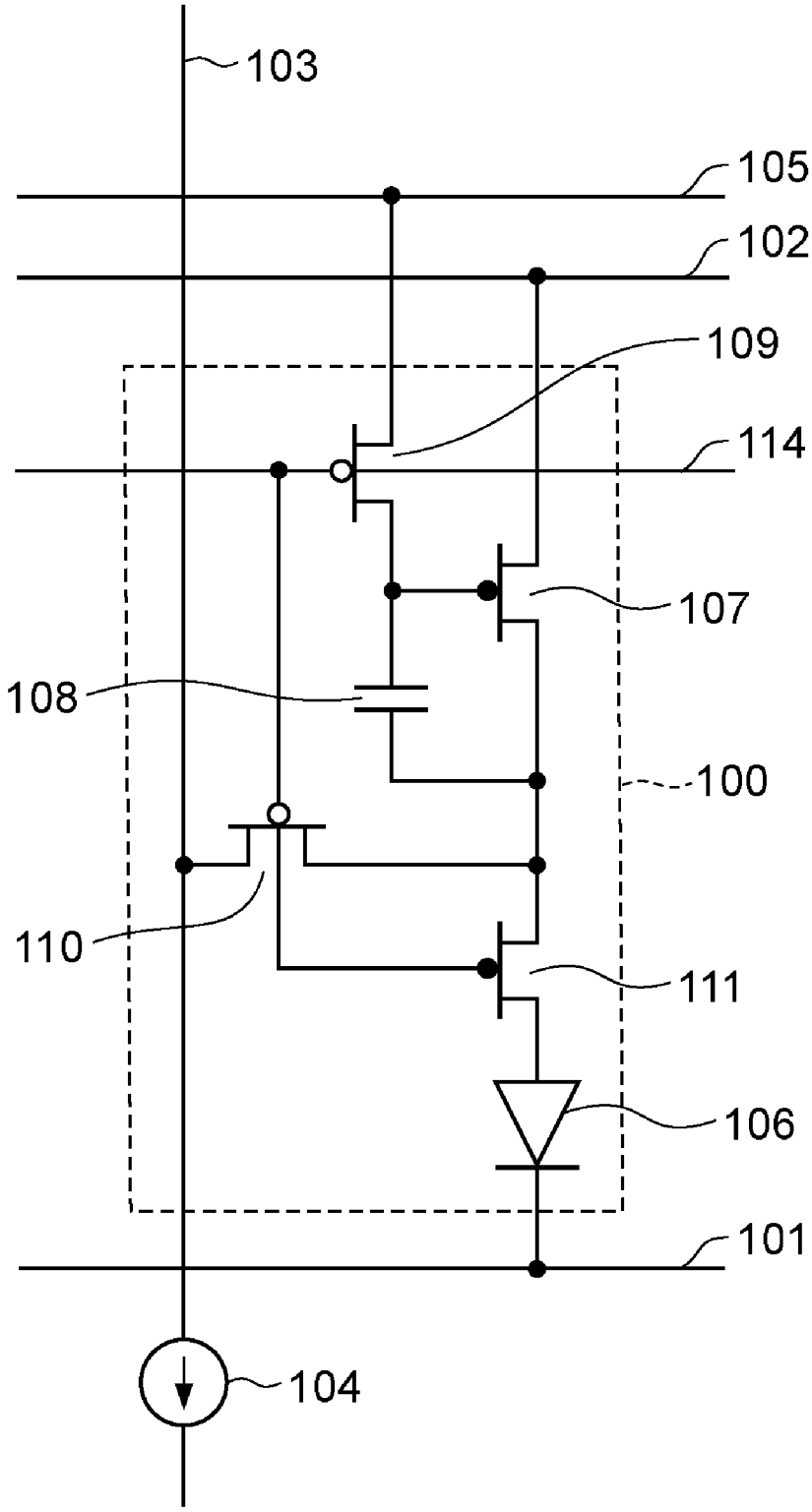
FIG. 19 is a diagram used to describe a driving circuit included in an organic EL display apparatus of a fifth example by focusing on a pixel circuit.

FIG. 19 shows an example of a circuit according to an embodiment of the present invention which is configured with a low-temperature polysilicon CMOS. In the case of a display apparatus in which a driving circuit is formed on a substrate, and the organic EL device 106 is formed on the driving circuit, the display apparatus can be easily produced by setting a pixel electrode connected to the drain of the driving TFT 107 as the anode of the organic EL device 106 and forming a metallic or transparent electroconductive film or the like on the entire top surface as the cathode of the organic EL device 106, because the first constant voltage source can be integrated therein. It is known that the organic EL device 106 included in the display apparatus produced in the above-described order has excellent carrier injection characteristics. A voltage drop in the organic EL device is reduced, whereby the power supply voltage can be easily reduced.

An n-channel TFT is used for each of the driving TFT and the third switch 111, and a p-channel TFT is used for each of the first switch 109 and the second switch 110. The gate of each TFT is connected to a corresponding one of the scanning lines 114. When a high-level signal is applied from the vertical shift register 115 to one of the scanning lines 114, the first switch 109 and the second switch 110 are closed and the third switch 111 is opened. When a low-level signal is applied to one of the scanning lines 114, operations of all switches are reversed. Accordingly, the sequences shown in FIG. 12 can be achieved with only one of the scanning lines 114.

SIXTH EXAMPLE

Figure 20:
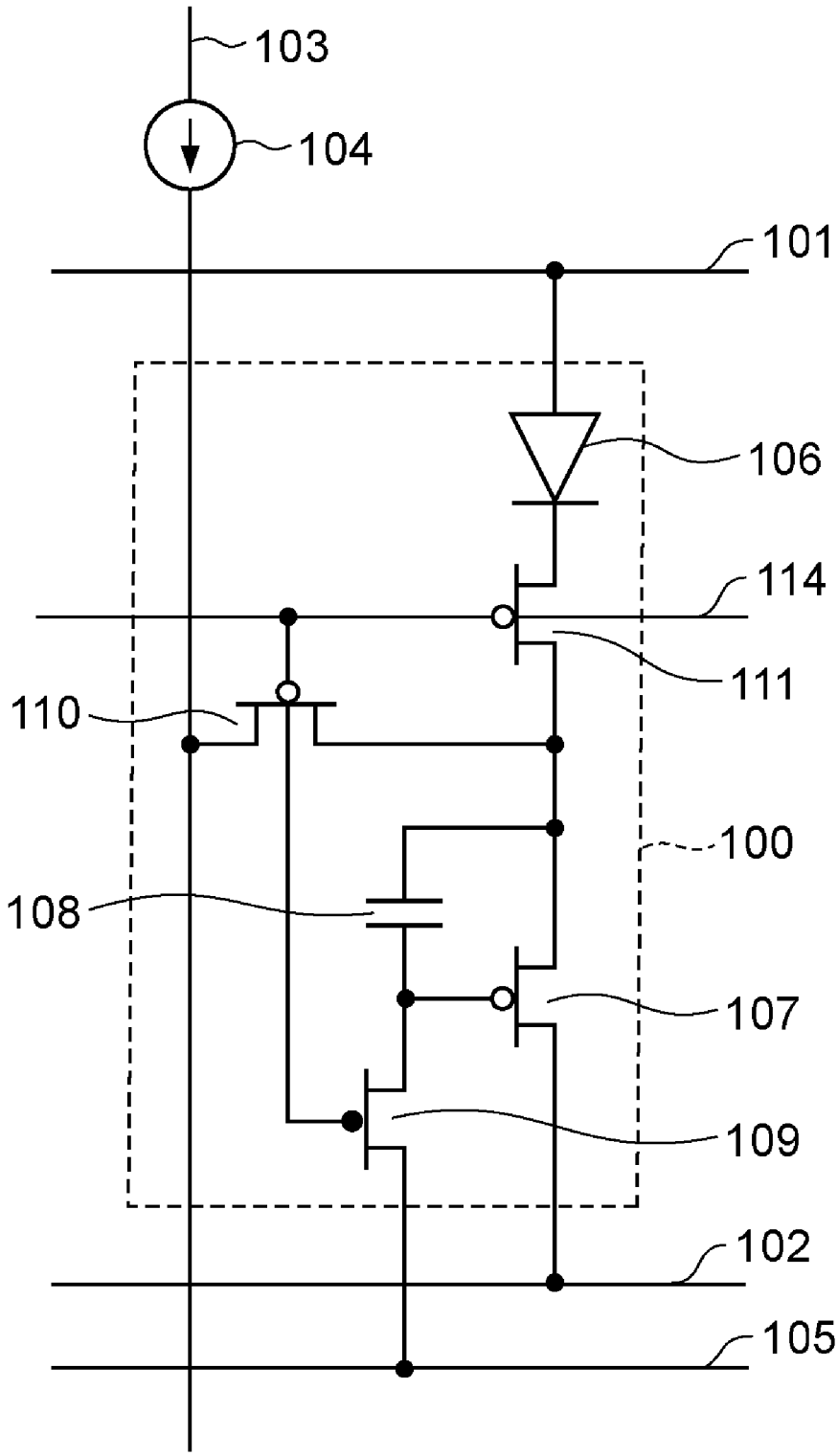
FIG. 20 is a diagram used to describe a driving circuit included in an organic EL display apparatus of a sixth example by focusing on a pixel circuit.

FIG. 20 shows another example of a circuit according to an embodiment of the present invention which is configured with a low-temperature polysilicon CMOS. Here, a display apparatus can be easily produced by setting a pixel electrode connected to the drain of the driving TFT 107 as the cathode of the organic EL device 106 and forming a metallic or transparent electroconductive film or the like on the entire top surface as the anode of the organic EL device 106, because the first constant voltage source can be integrated therein.

A p-channel TFT is used for each of the driving TFT and the third switch 111, and an n-channel TFT is used for each of the first switch 109 and the second switch 110. The gate of each TFT is connected to a corresponding one of the scanning lines 114. When a low-level signal is applied from the vertical shift register 115 to one of the scanning lines 114, the first switch 109 and the second switch 110 are closed and the third switch 111 is opened. When a high-level signal is applied to one of the scanning lines 114, operations of all switches are reversed. Accordingly, the sequences shown in FIG. 12 can be achieved with only one of the scanning lines 114. Circuits according to the first and second embodiments individually have an additional component, the third constant voltage power sources 105, compared with a known current programming circuit disclosed in U.S. Pat. No. 6,373,454. However, the number of circuit elements such as TFTs does not increase. Accordingly, the circuits can be easily produced and can be said to be practical circuits.

SEVENTH EXAMPLE

A capacitor is widely used as the voltage maintaining unit 108 in the circuit shown in FIG. 11. In the sequences shown in FIG. 12, since the first switch 109 is closed in the signal write period 502, a current flows into the voltage maintaining unit 108 and Vgs used to appropriately cause a signal current to pass through the drain and the source of the driving TFT is written therein. The written potential is required to be maintained with certainty in the image display period 503.

In the image display period 503, the written potential is not usually changed, because the first switch 109 is opened. However, if the third switch 111 is closed before the first switch 109 is opened and the source of the driving TFT 107 is connected to the organic EL device 106, a current may flow into the voltage maintaining unit 108 and the appropriately written potential may be changed. As shown in FIG. 19, the specification such as a conductivity type of the first switch 109 is often different from that of the third switch 111. State transition periods are therefore different between them. In addition, since a wiring capacity of one of the second constant voltage power sources 102 is different from that of one of the third constant voltage power sources 105, switching may not be appropriately performed.

Figure 21:
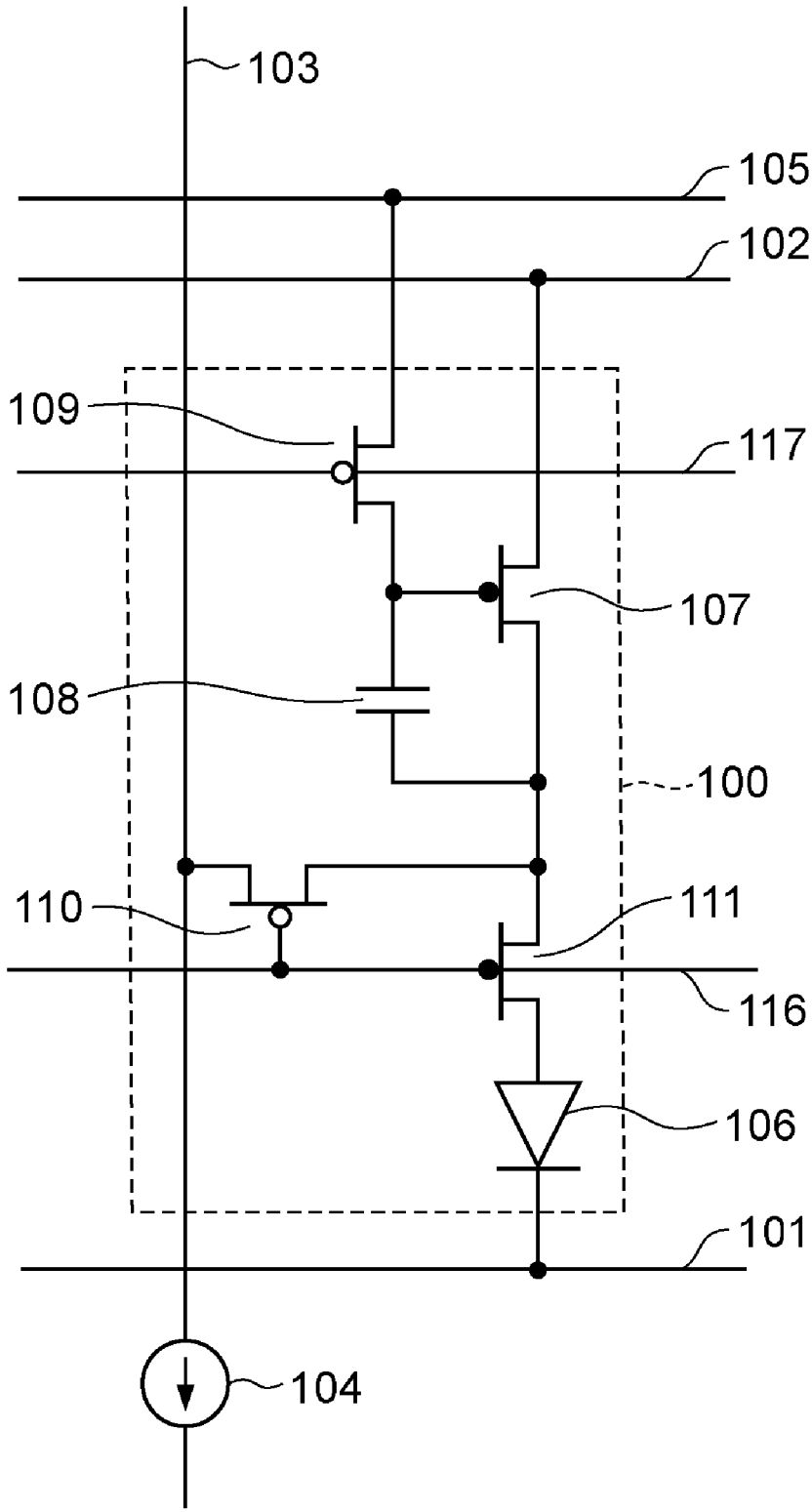
FIG. 21 is a diagram used to describe a driving circuit included in an organic EL display apparatus of a seventh example by focusing on a pixel circuit.

FIG. 21 shows an example of a circuit for precluding the possibility of error occurrence and performing switching from the signal write period 502 to the image display period 503 with certainty. A circuit shown in FIG. 21 is created on the basis of the circuit shown in FIG. 19. Circuit elements such as TFTs of the circuit shown in FIG. 21 are the same as those of the circuit shown in FIG. 19. However, in the circuit shown in FIG. 21, the scanning line 117 for the first switch 109 and the scanning line 116 for the second switch 110 and the third switch 111 are separately disposed. Accordingly, the method of delaying the switching time described in the third example with reference to FIG. 16 can be used for this example. Consequently, a current cannot improperly flow into the voltage maintaining unit 108. In addition, in the image display period, a driving current can properly flow.

EIGHTH EXAMPLE

Like the circuits shown in FIGS. 19 to 21, by using a CMOS, a plurality of switches can be driven in reverse phase in accordance with a signal transmitted from a single scanning line. Conversely, in the case of a polysilicon CMOS, the manufacturing process thereof is complex. In the case of metal oxide semiconductors such as amorphous silicon, ZnO, and InGaZnO, only n-channel TFTs can excellent characteristics. The above-described circuits cannot cover such a case.

Figure 22:
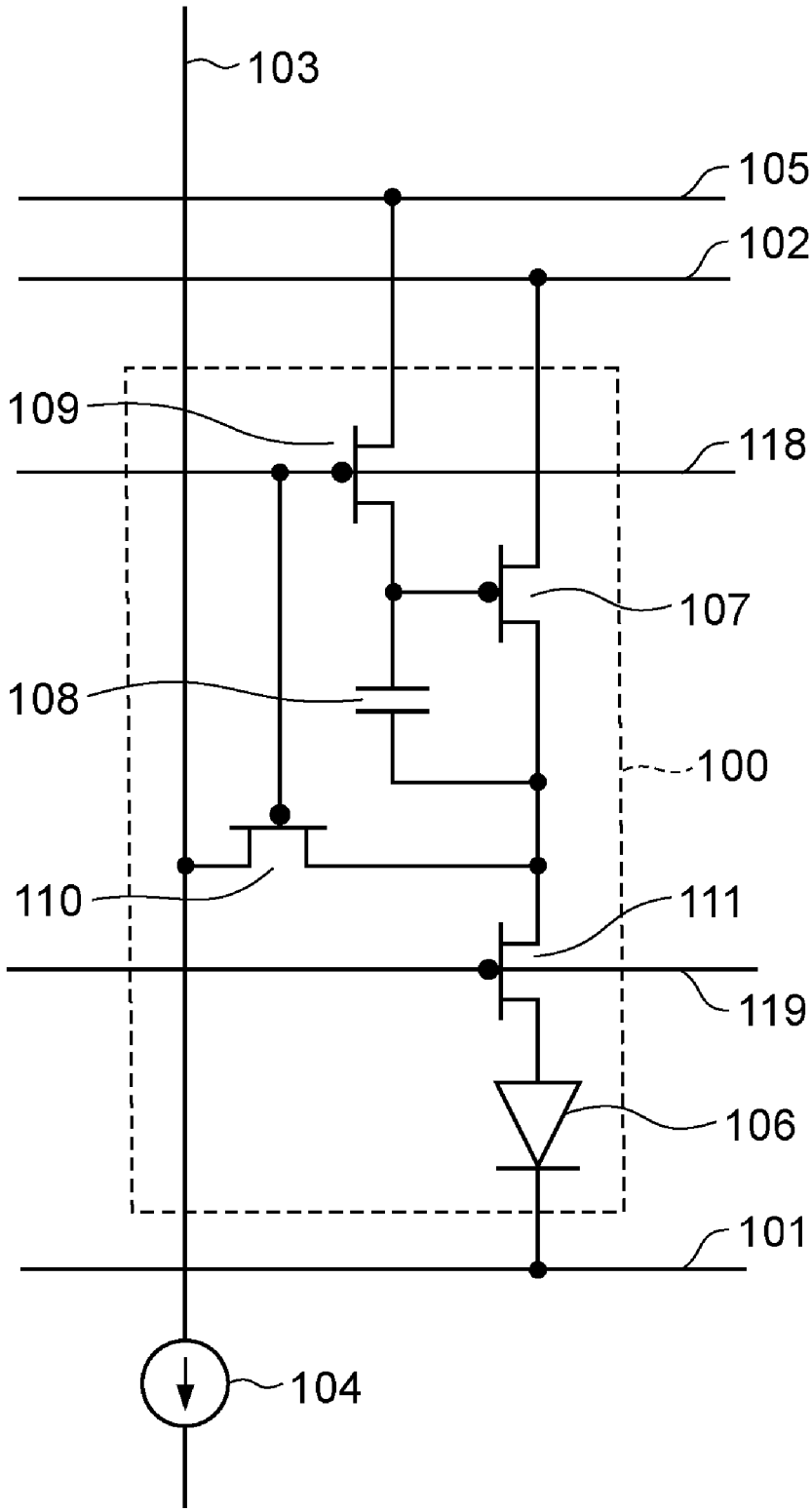
FIG. 22 is a diagram used to describe a driving circuit included in an organic EL display apparatus of an eighth example by focusing on a pixel circuit.

FIG. 22 shows an example of a circuit in which n-channel TFTs are used for all of the driving TFT 107, the first switch 109, the second switch 110, and the third switch 111. Here, the gates of the first switch 109 and the second switch 110 are connected to the first scanning line 118. On the other hand, the gate of the third switch 111 is connected to the second scanning line 119. Accordingly, the sequences shown in FIG. 12 can be achieved by providing signals having opposite phases to the scanning lines 118 and 119.

Like the case described in the fourth example with reference to FIG. 18, signal switching of the first scanning line 118 precedes signal switching of the second scanning line 119 by a predetermined period Δt. Consequently, like the circuit of the seventh example, a signal written in the voltage maintaining unit 108 can be accurately maintained.

NINTH EXAMPLE

Figure 23:
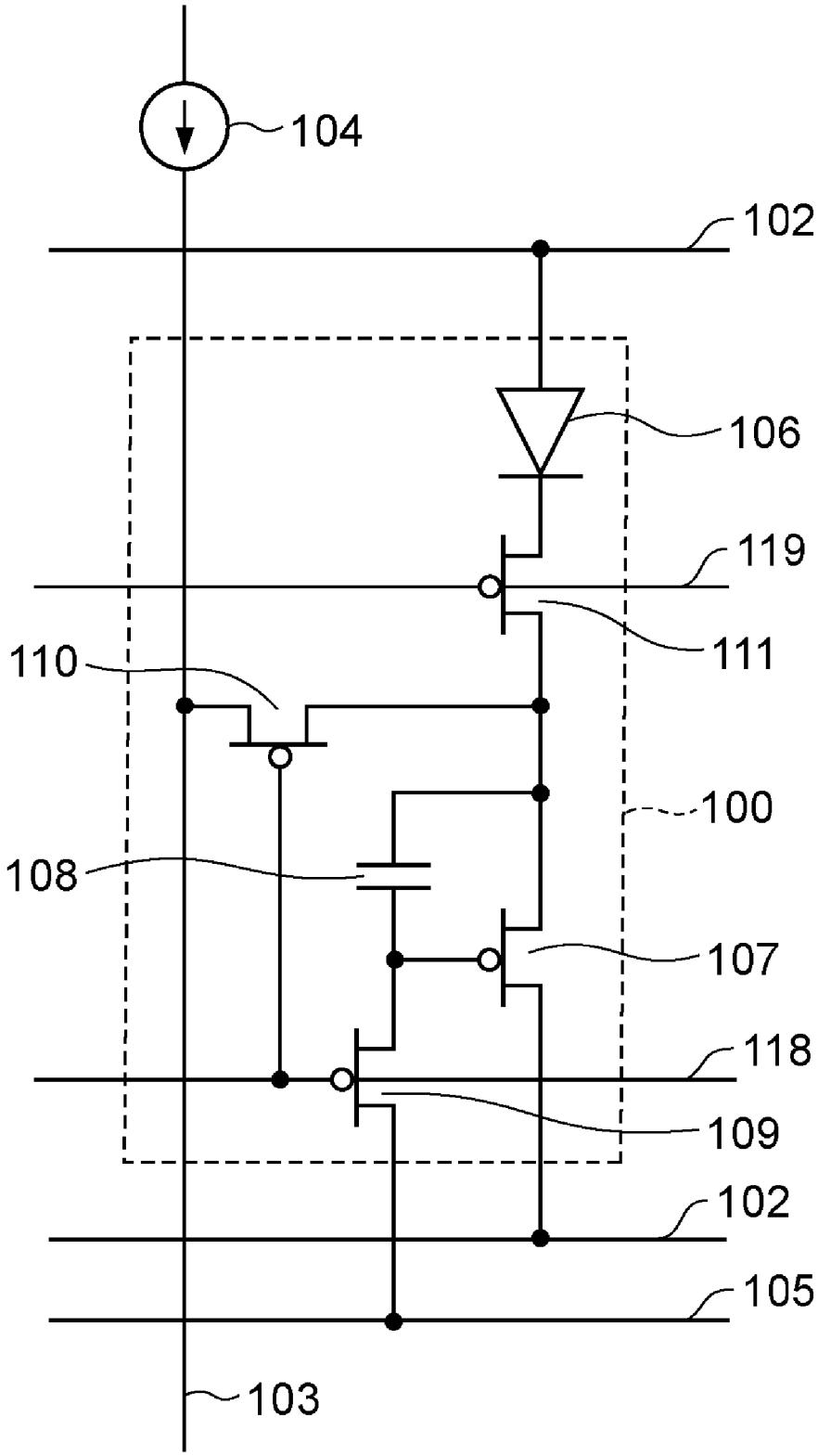
FIG. 23 is a diagram used to describe a driving circuit included in an organic EL display apparatus of a ninth example by focusing on a pixel circuit.

FIG. 23 shows an example of a circuit suitable for a case in which p-channel TFTs such as TFTs with organic semiconductors are used. The gates of the first switch 109 and the second switch 110 are also connected to the first scanning line 118. On the other hand, the gate of the third switch 111 is connected to the second scanning line 119. Accordingly, signals having opposite phases are provided for the scanning lines 118 and 119, whereby the sequences shown in FIG. 12 can be achieved. Furthermore, like the circuit of the fourth example, switching from the signal write period to the image display period can be performed with certainty by using the sequences shown in FIG. 18.

TENTH EXAMPLE

Figure 24:
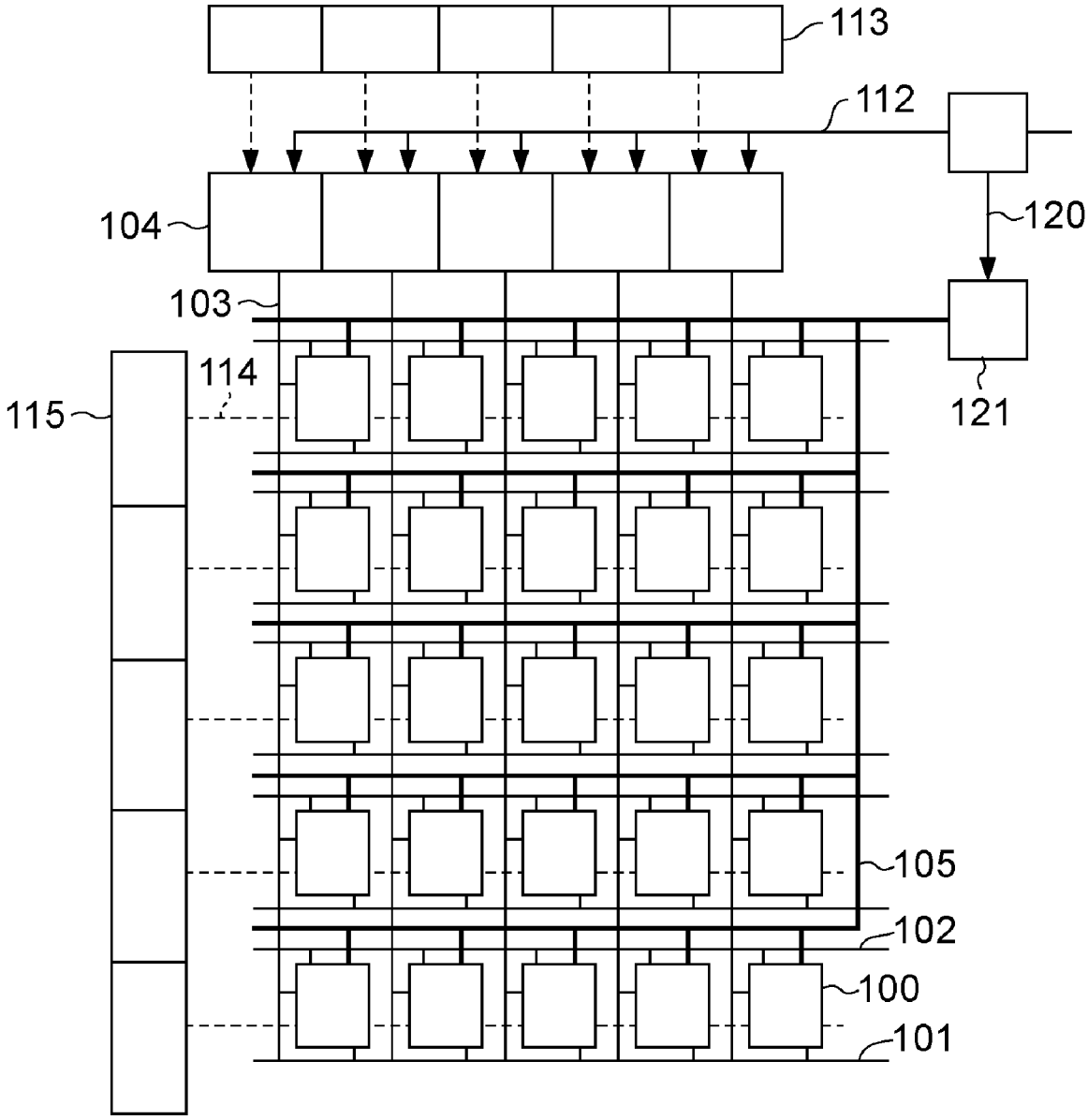
FIG. 24 is a block diagram showing a configuration of an organic EL display apparatus of a tenth example.

In a circuit shown in FIG. 24, a signal analyzer 120 and a voltage source 121 are added to the components included in the circuit shown in FIG. 2. The signal analyzer 120 analyzes an image signal and the frequency of occurrence of a luminance level in an image, and extracts a representative luminance level. The voltage source 121 obtains a voltage that can most faithfully achieve the luminance level by using the value of a signal current corresponding to the luminance level and equation 5, and outputs the obtained voltage to the third constant voltage power sources 105. According to the additional components, for example, when characters are displayed against the background with uniform brightness on a computer monitor, the potential of the third constant voltage source is set on the basis of the luminance of the background. As a result, background nonuniformity due to variations of saturation characteristics of a driving TFT can be improved. In the case of moving images on a TV screen, an image signal, which is provided every one frame, is analyzed. The potential of one of the third constant voltage power sources 105 is set on the basis of a luminance level that has occurred at high frequency in the preceding frame. As a result, moving images can be accurately displayed at desired luminance. Thus, high-quality images can be efficiently obtained. The circuit shown in FIG. 24 may be simplified by removing the signal analyzer 120. In this case, the voltage source 121 may be manually controlled so as to control the potentials of the third constant voltage power sources 105.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Applications No. 2006-098009 filed Mar. 31, 2006 and No. 2006-098010 filed Mar. 31, 2006, which are hereby incorporated by reference herein in their entirety.

What is claimed is:

1. A driving method of an organic EL device in which, when the organic EL device emits light, a source and a drain of a driving transistor and an anode and a cathode of the organic EL device are connected in series between first and second constant voltage sources and a current flows between the anode and the cathode of the organic EL device in accordance with a gate-to-source voltage of the driving transistor, the gate-to-source voltage of the driving transistor being set in the following steps:

(1) disconnecting the series connection of the driving transistor and the organic EL device at the source of the driving transistor;

(2) connecting a third constant voltage source maintaining a potential difference from a potential of each of the first and second constant voltage sources to a gate of the driving transistor;

(3) connecting the source of the driving transistor to a signal current source and passing a signal current between the source and the drain of the driving transistor to generate a voltage between the gate and the source of the driving transistor in a capacitor disposed between the gate and the source of the driving transistor;

(4) disconnecting the gate of the driving transistor from the third constant voltage source;

(5) disconnecting the source of the driving transistor from the signal current source; and (6) reconnecting the source of the driving transistor to recover the series connection of the driving transistor and the organic EL device.

2. The driving method according to claim 1, wherein the series connection is established by connecting the drain of the driving transistor to the anode or cathode of the organic EL device.

3. The driving method according to claim 2, wherein a potential of the third constant voltage source is set to a value closer to a potential of the second constant voltage source on the basis of a potential of the first constant voltage source, and wherein, a voltage between the third and first constant voltage sources is equal to or larger than a sum of an anode-to-cathode voltage of the organic EL device and a gate-to-source voltage of the driving transistor, the voltages being obtained in the step (3) when the signal current is a signal current that minimizes luminance of an organic EL display apparatus, and is equal to or smaller than a sum of an anode-to-cathode voltage of the organic EL device and a gate-to-source voltage of the driving transistor, the voltages being obtained in the step (3) when the signal current is a signal current that maximizes luminance of the organic EL display apparatus.

4. The driving method according to claim 2, wherein a voltage between the first and second constant voltage sources is equal to or larger than a sum of a source-to-drain voltage of the driving transistor and an anode-to-cathode voltage of the organic EL device, the voltages being obtained in the step (3) when the signal current is a signal current that maximizes luminance of the organic EL display apparatus, and is smaller than a sum of a source-to-drain voltage of the driving transistor, an anode-to-cathode voltage of the organic EL device, and a threshold voltage of the driving transistor, the voltages being obtained in the step (3) when the signal current is a signal current that maximizes luminance of the organic EL display apparatus.

5. The driving method according to claim 1, wherein the series connection is established by connecting the source of the driving transistor to the anode or cathode of the organic EL device.

6. The driving method according to claim 5, wherein a potential of the third constant voltage source is equal to or larger than a sum of a gate-to-source voltage of the driving transistor and an anode-to-cathode voltage of the organic EL device, the voltages being obtained when the signal current is a signal current that minimizes luminance to be used at the time of display, and is equal to or smaller than a sum of a gate-to-source voltage of the driving transistor and an anode-to-cathode voltage of the organic EL device, the voltages being obtained when the signal current is a signal current that maximizes luminance to be used at the time of display.

7. The driving method according to claim 5, wherein a potential of the third constant voltage source is a sum of a gate-to-source voltage of the driving transistor and an anode-to-cathode voltage of the organic EL device, the voltages being obtained when the signal current is a signal current that sets luminance to be used at the time of display to average luminance.

8. The driving method according to claim 1, wherein the steps (4) and (5) are simultaneously performed.

9. The driving method according to claim 1, wherein the step (4) follows the step (5) after a predetermined time delay.

10. An organic EL display apparatus, comprising:

an organic EL device having two terminals, an anode and a cathode;

a driving transistor having three terminals, a gate, a source, and a drain;

a capacitor disposed between the gate and the source of the driving transistor;

first, second, and third constant voltage sources each maintaining a constant voltage;

a signal current source providing a signal current;

a first switch disposed between the gate of the driving transistor and the third constant voltage source;

a second switch disposed between the source of the driving transistor and the signal current source;

a third switch disposed between the source of the driving transistor and the second constant voltage source; and opening and closing control means for controlling opening and closing of the first to third switches.

11. The organic EL display apparatus according to claim 10, wherein the first to third switches are each configured with a respective TFT, channel conductivity types of the TFTs of the first and second switches being the same, and a channel conductivity type of the TFT of the third switch being different from that of the TFTs of the first and second switches, and wherein the opening and closing control means is a control line connected to gates of the TFTs of the first to third switches.

12. The organic EL display apparatus according to claim 10, wherein the first to third switches are each configured with a respective TFT, channel conductivity types of the TFTs of the second and third switches being different, and wherein the opening and closing control means includes a first control line connected to gates of the TFTs of the second and third switches, and a second control line connected to a gate of the TFT of the first switch.

13. The organic EL display apparatus according to claim 11, wherein the first to third switches are each configured with a TFT having the same channel conductivity types as a conductivity type of the driving transistor, and wherein the opening and closing control means includes a first control line connected to gates of the TFTs of the first and second switches, and a second control line connected to a gate of the TFT of the third switch.

14. The organic EL display apparatus according to claim 11, wherein TFTs of the first to third switches and the driving transistor are made of amorphous silicon.

15. The organic EL display apparatus according to claim 11, wherein TFTs of the first to third switches and the driving transistor are made of metal oxide semiconductor.

* * * * *